US010629343B2

(12) United States Patent
Eguchi et al.

(10) Patent No.: US 10,629,343 B2
(45) Date of Patent: Apr. 21, 2020

(54) RARE EARTH PERMANENT MAGNET AND RARE EARTH PERMANENT MAGNET MANUFACTURING METHOD

(71) Applicant: IHI CORPORATION, Tokyo (JP)

(72) Inventors: Haruki Eguchi, Tokyo (JP); Isao Nakanowatari, Tokyo (JP); Natsuki Yoneyama, Tokyo (JP); Hidekazu Tomono, Tokyo (JP); Hiroo Takahashi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 424 days.

(21) Appl. No.: 15/146,932

(22) Filed: May 5, 2016

(65) Prior Publication Data

US 2016/0322135 A1 Nov. 3, 2016

Related U.S. Application Data

(63) Continuation of application No. PCT/JP2014/079183, filed on Nov. 4, 2014.

(30) Foreign Application Priority Data

Nov. 5, 2013 (JP) ..... 2013-229783
Nov. 5, 2013 (JP) ..... 2013-229786
(Continued)

(51) Int. Cl.
*H01F 1/057* (2006.01)
*B22F 3/00* (2006.01)
(Continued)

(52) U.S. Cl.
CPC ..... *H01F 1/057* (2013.01); *B22F 3/00* (2013.01); *C21D 6/007* (2013.01); *C21D 9/0068* (2013.01);
(Continued)

(58) Field of Classification Search
CPC ..... H01F 1/057; C22C 38/16; C22C 38/14; C22C 38/12
See application file for complete search history.

(56) References Cited

U.S. PATENT DOCUMENTS 5,645,651 A 7/1997 Fujimura et al.
5,976,271 A 11/1999 Nomura et al.
(Continued)

FOREIGN PATENT DOCUMENTS

EP 1462531 A2 9/2004
JP 11-008109 A 1/1999
(Continued)

OTHER PUBLICATIONS

Japanese Office Action dated May 1, 2018 for the Japanese Patent Application No. 2015-546639.
(Continued)

*Primary Examiner* — Colleen P Dunn
*Assistant Examiner* — Anthony M Liang
(74) *Attorney, Agent, or Firm* — Volpe and Koenig, P.C.

(57) ABSTRACT

A magnetic property of a rare earth permanent magnet containing neodymium, iron, and boron is enhanced. The present disclosure is a rare earth permanent magnet with a compound represented by a following expression as a main phase: $Nd_2Fe_{14}B_{(1-x)}M_x$. In the expression, M represents an element selected from any one of cobalt, beryllium, lithium, aluminum, and silicon and x satisfies $0.01 \leq x \leq 0.25$. The main phase has an Nd—Fe—B layer and an Fe layer periodically and part of boron is substituted with any one or more types of elements selected from a group consisting of cobalt, beryllium, lithium, aluminum, and silicon.

25 Claims, 43 Drawing Sheets

(30) Foreign Application Priority Data

| | | |
|---|---|---|
| Jan. 8, 2014 | (JP) | 2014-002050 |
| Jan. 8, 2014 | (JP) | 2014-002051 |
| May 28, 2014 | (JP) | 2014-110669 |

(51) Int. Cl.

| | |
|---|---|
| ***C22C 38/00*** | (2006.01) |
| ***H01F 41/02*** | (2006.01) |
| ***C22C 33/02*** | (2006.01) |
| ***C21D 6/00*** | (2006.01) |
| ***C21D 9/00*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C22C 33/0278* (2013.01); *C22C 38/00* (2013.01); *C22C 38/002* (2013.01); *C22C 38/005* (2013.01); *C22C 38/06* (2013.01); *C22C 38/10* (2013.01); *C22C 38/12* (2013.01); *C22C 38/14* (2013.01); *C22C 38/16* (2013.01); *H01F 1/0577* (2013.01); *H01F 41/0253* (2013.01); *H01F 41/0273* (2013.01); *B22F 2998/10* (2013.01); *B22F 2999/00* (2013.01); *C22C 2202/02* (2013.01)

(56) References Cited

U.S. PATENT DOCUMENTS

| | | | | |
|---|---|---|---|---|
| 2006/0005898 | A1 | 1/2006 | Liu et al. | |
| 2006/0016515 | A1 | 1/2006 | Tomizawa et al. | |
| 2007/0175544 | A1 | 8/2007 | Hasegawa et al. | |
| 2010/0003156 | A1* | 1/2010 | Suzuki | B22F 1/025 419/10 |
| 2010/0104767 | A1 | 4/2010 | Sskuma et al. | |
| 2014/0286815 | A1 | 9/2014 | Ishiyama et al. | |

FOREIGN PATENT DOCUMENTS

| | | | |
|---|---|---|---|
| JP | 2001-217112 | A | 8/2001 |
| JP | 2002-038245 | A | 2/2002 |
| JP | 2002-327255 | A | 11/2002 |
| JP | 2003-217918 | A | 7/2003 |
| JP | 2003-226944 | A | 8/2003 |
| JP | 2005-320628 | A | 11/2005 |
| JP | 2006-041507 | A | 2/2006 |
| JP | 2008-505500 | A | 2/2008 |
| JP | 2008-117855 | A | 5/2008 |
| JP | 2010-074062 | A | 4/2010 |
| JP | 2010-150604 | A | 7/2010 |
| WO | 2013/054854 | A1 | 4/2013 |

OTHER PUBLICATIONS

Extended European Search Report, European Patent Application No. 14860236.0, dated Jun. 30, 2017, 10 pgs.

Sagawa, M., et al., "ND—FE—B Permanent Magnet Materials," Japanese Journal of Applied Physics, JP, vol. 26, No. 6, Jun. 1, 1987 (Jun. 1, 1987), pp. 785-800.

Japanese Office Action with English Translation, Japanese Application No. 2015-546639, dated Jul. 4, 2017, 8 pgs.

G.S. Chaubey et al., "Synthesis and Stabilization of FeCo Nanoparticles," J. Am. Chem. Soc. 9 vol. 129, No. 23, 2007, pp. 7214-7215.

International Search Report, PCT/JP2014/079183, dated Feb. 10, 2015, 2 pgs.

* cited by examiner

Partial electron density of states (PDOS) of d orbitals and f orbitals of entire iron and neodymium atoms in $Nd_2Fe_{14}B$ crystal Total electron density of states (DOS) of $Nd_2Fe_{14}B$ crystal

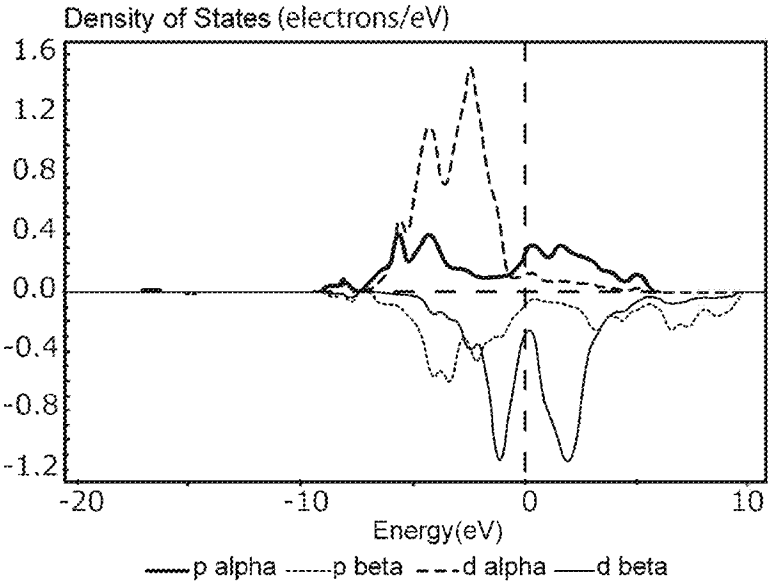
Partial electron density of states (PDOS) of B-Fe nearest neighbor atoms: p orbitals and d orbitals
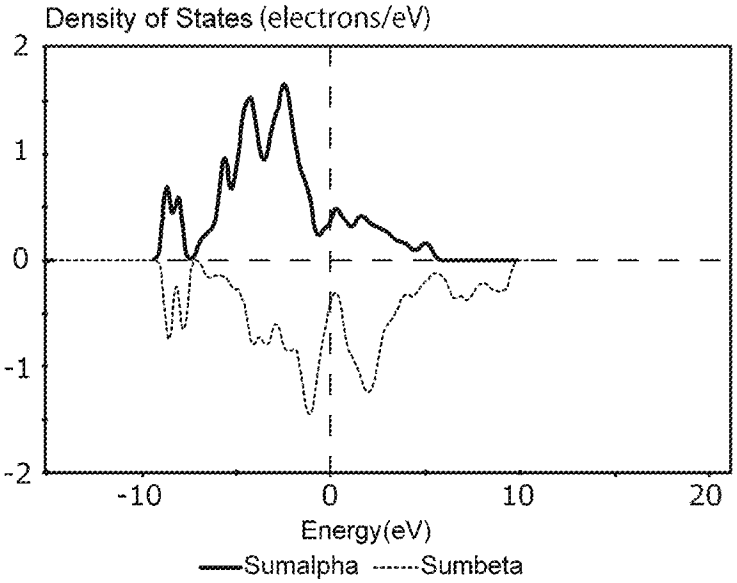
Partial electron density of states (PDOS) of B-Fe nearest neighbor atoms: sum of s, p, and d orbitals
FIG.4

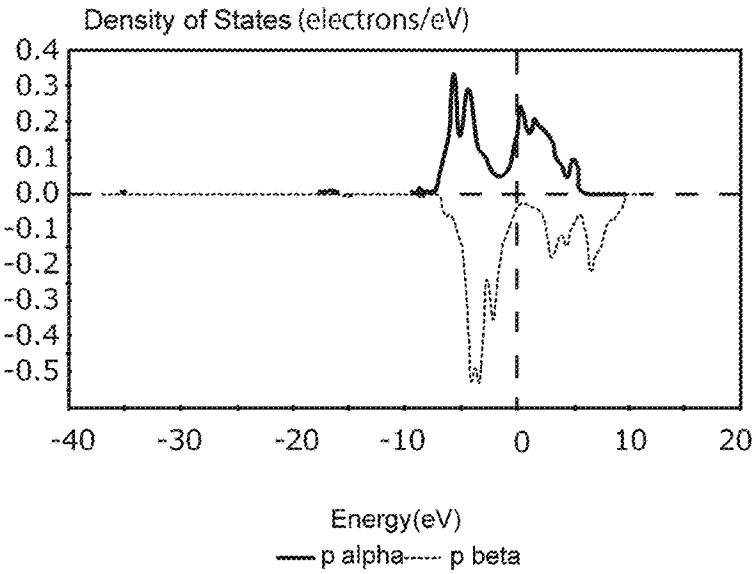
Local electron density of states at p orbitals of boron atom in $Nd_2Fe_{14}B$
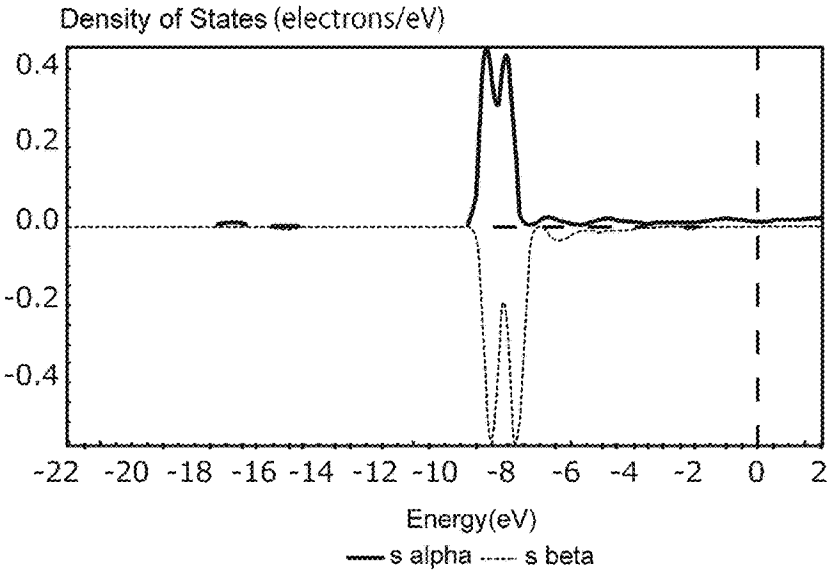
Local electron density of states at s orbital of boron atom in $Nd_2Fe_{14}B$
FIG.5

FIG.7

(wt%)

| | Nd | Pr | Tb | B | Al | Cu | Co | Nb | Zr | Ti | Ga | Fe |
|---|---|---|---|---|---|---|---|---|---|---|---|---|
| Example 6 | 26.20 | — | 4.800 | 0.970 | 0.300 | 0.080 | 0.900 | 0.300 | — | — | — | 66.45 |
| Example 7 | 30.49 | — | — | 0.970 | 0.200 | 0.050 | 0.900 | — | — | — | — | Bal. |
| Example 8 | 22.16 | 5.540 | 2.800 | 0.970 | 0.300 | 0.080 | 0.900 | 0.190 | — | — | — | 67.06 |
| Example 9 | 20.96 | 5.240 | 4.800 | 0.970 | 0.300 | 0.080 | 0.900 | 0.195 | — | — | — | 66.55 |
| Example 10 | 20.96 | 5.240 | 5.300 | 0.970 | 0.300 | 0.080 | 0.900 | 0.190 | — | — | — | 66.06 |
| Example 11 | 18.80 | 4.700 | 9.000 | 0.960 | 0.350 | 0.100 | 1.700 | — | 0.040 | 0.040 | — | 67.06 |
| Example 12 | 20.96 | 5.240 | 4.500 | 0.960 | 0.150 | 0.100 | 1.700 | — | 0.040 | 0.040 | 0.150 | Bal. |
| Example 13 | 26.20 | — | 4.600 | 0.970 | 0.300 | 0.080 | 0.900 | 0.195 | — | — | — | Bal. |
| Example 14 | 21.00 | 5.200 | 4.600 | 0.970 | 0.300 | 0.080 | 0.900 | 0.195 | — | — | — | Bal. |
| Comparative Example 1 | 26.39 | — | — | 0.740 | — | — | 1.350 | — | — | — | — | 71.52 |
| Comparative Example 2 | 26.56 | — | — | 0.900 | — | — | 0.540 | — | — | — | — | 72.00 |

FIG.8

| | Heat Treatment Conditions | Temperature When Measured (°C) | Residual Magnetic Flux Density Br (kG) | Coercive Force Hcj (kOe) | Maximum Energy Product BHmax (MGOe) | Tensile Strength (MPa) |
|---|---|---|---|---|---|---|
| Example 6-1 | After retained at 1050°C for 4 hours, retained at 910°C for 3 hours and further retained at 480°C for 4 hours | 100 | 11.87 | 18.30 | 33.40 | 141.70 |
| | | 160 | 10.97 | 11.07 | 28.25 | |
| Example 6-2 | After retained at 1050°C for 4 hours, retained at 910°C for 3 hours and further retained at 500°C for 4 hours | 100 | 11.84 | 18.29 | 33.38 | 140.69 |
| | | 160 | 10.86 | 11.30 | 27.90 | |
| Example 6-3 | After retained at 1055°C for 4 hours, retained at 910°C for 3 hours and further retained at 480°C for 4 hours | 100 | 11.83 | 18.45 | 33.55 | 115.25 |
| | | 160 | 10.91 | 11.39 | 28.22 | |
| Example 6-4 | After retained at 1055°C for 4 hours, retained at 910°C for 3 hours and further retained at 500°C for 4 hours | 100 | 11.81 | 18.66 | 33.45 | 156.38 |
| | | 160 | 10.85 | 11.33 | 27.88 | |

FIG.9

| | Heat Treatment Conditions | Temperature When Measured (°C) | Residual Magnetic Flux Density Br (kG) | Coercive Force Hcj (kOe) | Maximum Energy Product BHmax (MGOe) |
|---|---|---|---|---|---|
| Example 6-5 | After retained at 1055°C for 3 hours, retained at 910°C for 3 hours and further retained at 500°C for 4 hours | 20 | 13.06 | 27.91 | 40.71 |
| | | 100 | 11.83 | 17.42 | 33.91 |
| | | 160 | 10.94 | 10.52 | 28.03 |
| | | 200 | 10.12 | 6.680 | 23.71 |
| Example 6-6 | After retained at 1055°C for 3 hours, retained at 910°C for 3 hours and further retained at 500°C for 4 hours | 20 | 12.99 | 28.24 | 40.19 |
| | | 100 | 11.87 | 17.63 | 33.48 |
| | | 160 | 10.96 | 10.61 | 28.35 |
| | | 200 | 10.12 | 6.75 | 23.81 |
| Example 6-7 | After retained at 1055°C for 3 hours, retained at 910°C for 3 hours and further retained at 500°C for 4 hours | 20 | 13.03 | 28.26 | 40.72 |
| | | 100 | 11.91 | 17.64 | 33.92 |
| | | 160 | 10.97 | 10.60 | 28.41 |
| | | 200 | 10.12 | 6.61 | 23.70 |

FIG.10

| | Heat Treatment Conditions | Temperature When Measured (°C) | Residual Magnetic Flux Density Br (kG) | Coercive Force Hcj (kOe) | Maximum Energy Product BHmax (MGOe) |
|---|---|---|---|---|---|
| Example 6-8 | After retained at 1055°C for 3 hours, retained at 910°C for 3 hours and further retained at 500°C for 4 hours | 20 | 12.99 | 28.16 | 40.30 |
| | | 100 | 11.87 | 17.58 | 33.57 |
| | | 160 | 10.92 | 10.73 | 28.19 |
| | | 200 | 10.16 | 6.93 | 24.07 |
| Example 6-9 | After retained at 1055°C for 3 hours, retained at 910°C for 3 hours and further retained at 500°C for 4 hours | 20 | 13.05 | 28.42 | 40.66 |
| | | 100 | 11.92 | 17.74 | 33.87 |
| | | 160 | 10.99 | 10.62 | 28.49 |
| | | 200 | 10.14 | 6.98 | 24.11 |

| Ion | Count | atomic% |
|---|---|---|
| Nd | 61 | 9.4 |
| B | 21 | 3.3 |
| Co | 4 | 0.6 |

| Ion | Count | atomic% |
|---|---|---|
| Nd | 65 | 9.7 |
| B | 18 | 2.6 |
| Co | 5 | 0.7 |

| Ion | Count | atomic% |
|---|---|---|
| Nd | 60 | 9.9 |
| B | 20 | 3.3 |
| Co | 6 | 1.0 |

FIG.27

| Site Name | Element Name | Occupancy | x | y | z |
|---|---|---|---|---|---|
| 4f | Nd | 0.814676 | 0.356875 | 0.357864 | 0.000000 |
| 4f | Tb | 0.177184 | 0.356875 | 0.357864 | 0.000000 |
| 4f | Co | 0.008140 | 0.356875 | 0.357864 | 0.000000 |
| 4g | Nd | 0.813800 | 0.770062 | 0.229938 | 0.000000 |
| 4g | Tb | 0.181548 | 0.770062 | 0.229938 | 0.000000 |
| 4e | Fe | 1.000000 | 0.000000 | 0.000000 | 0.113721 |
| 4c | Fe | 1.000000 | 0.000000 | 0.500000 | 0.000000 |
| 8j | Fe | 1.000000 | 0.099293 | 0.099293 | 0.294200 |
| 8j | Fe | 0.856556 | 0.314724 | 0.314724 | 0.251185 |
| 8j | Co | 0.143444 | 0.314724 | 0.314724 | 0.251185 |
| 16k | Fe | 1.000000 | 0.567055 | 0.225494 | 0.373063 |
| 16k | Fe | 0.857902 | 0.138735 | 0.535811 | 0.176273 |
| 16k | Co | 0.142098 | 0.138735 | 0.535811 | 0.176273 |
| 4f | B | 0.926232 | 0.140275 | 0.140275 | 0.000000 |
| 4f | Co | 0.073768 | 0.140275 | 0.140275 | 0.000000 |

FIG.28

| | Heat Treatment Conditions | Test Specimen Number | Residual Magnetic Flux Density Br (kG) | Coercive Force Hcj (kOe) | Maximum Energy Product BHmax (MGOe) |
|---|---|---|---|---|---|
| Example 7-1 | After retained at 1045°C for 4 hours, retained at 910°C for 3 hours and further retained at 480°C for 4 hours | 1 | 14.22 | 8.13 | 47.05 |
| | | 2 | 14.29 | 8.26 | 47.13 |
| Example 7-2 | After retained at 1045°C for 4 hours, retained at 910°C for 3 hours and further retained at 520°C for 4 hours | 1 | 14.30 | 9.45 | 48.03 |
| | | 2 | 14.29 | 9.62 | 48.42 |
| Example 7-3 | After retained at 1055°C for 4 hours, retained at 910°C for 3 hours and further retained at 480°C for 4 hours | 1 | 14.44 | 7.26 | 31.37 |
| | | 2 | 14.03 | 7.66 | 32.37 |

FIG.29

| | Heat Treatment Conditions | Test Specimen Number | Residual Magnetic Flux Density Br (kG) | Coercive Force Hcj (kOe) | Maximum Energy Product BHmax (MGOe) |
|---|---|---|---|---|---|
| Example 7-4 | After retained at 1055°C for 4 hours, retained at 910°C for 3 hours and further retained at 520°C for 4 hours | 1 | 13.92 | 8.940 | 35.59 |
| | | 2 | 14.08 | 9.030 | 37.36 |
| Example 7-5 | After retained at 1035°C for 4 hours, retained at 910°C for 3 hours and further retained at 480°C for 4 hours | 1 | 14.09 | 8.350 | 46.27 |
| | | 2 | 14.15 | 7.990 | 46.16 |

FIG.31

| Site Name | Element Name | Occupancy | x | y | z |
|---|---|---|---|---|---|
| 4f | Nd | 0.9945400 | 0.3568750 | 0.3578640 | 0.0000000 |
| 4f | Co | 0.0054601 | 0.3568750 | 0.3578640 | 0.0000000 |
| 4g | Nd | 1.0000000 | 0.7705290 | 0.2294710 | 0.0000000 |
| 4e | Fe | 0.6121210 | 0.0000000 | 0.0000000 | 0.1138300 |
| 4e | Co | 0.3878790 | 0.0000000 | 0.0000000 | 0.1138300 |
| 4c | Fe | 0.7131200 | 0.0000000 | 0.5000000 | 0.0000000 |
| 4c | Co | 0.2868800 | 0.0000000 | 0.5000000 | 0.0000000 |
| 8j | Fe | 1.0000000 | 0.1000560 | 0.1000560 | 0.2942000 |
| 8j | Fe | 0.8106550 | 0.3162560 | 0.3162560 | 0.2528500 |
| 8j | Co | 0.1893450 | 0.3162560 | 0.3162560 | 0.2528500 |
| 16k | Fe | 1.0000000 | 0.5667590 | 0.2242540 | 0.3726660 |
| 16k | Fe | 0.7822160 | 0.1385470 | 0.5357580 | 0.1754180 |
| 16k | Co | 0.2177840 | 0.1385470 | 0.5357580 | 0.1754180 |
| 4f | B | 0.9260190 | 0.1344480 | 0.1344480 | 0.0000000 |
| 4f | Co | 0.0739813 | 0.1344480 | 0.1344480 | 0.0000000 |

FIG.32

| | Heat Treatment Conditions | Temperature When Measured (°C) | Residual Magnetic Flux Density Br (kG) | Coercive Force Hcj (kOe) | Maximum Energy Product BHmax (MGOe) | Tensile Strength (MPa) |
|---|---|---|---|---|---|---|
| Example 8-1 | After retained at 1055°C for 3 hours, retained at 910°C for 3 hours and further retained at 500°C for 4 hours | 20 | 13.35 | 21.26 | 43.17 | 102.61 |
| | | 100 | 12.41 | 11.82 | 36.80 | |
| | | 160 | 11.34 | 6.240 | 29.67 | |
| | | 200 | 10.46 | 3.850 | 21.65 | |
| Example 8-2 | After retained at 1055°C for 3 hours, retained at 910°C for 3 hours and further retained at 500°C for 4 hours | 20 | 13.38 | 21.49 | 43.33 | 111.88 |
| | | 100 | 12.40 | 12.03 | 36.55 | |
| | | 160 | 11.33 | 6.330 | 29.63 | |
| | | 200 | 10.41 | 3.850 | 21.86 | |
| Example 8-3 | After retained at 1055°C for 3 hours, retained at 910°C for 3 hours and further retained at 500°C for 4 hours | 20 | 13.36 | 21.24 | 42.90 | 119.46 |
| | | 100 | 12.39 | 11.88 | 36.34 | |
| | | 160 | 11.33 | 6.390 | 29.70 | |
| | | 200 | 10.43 | 3.830 | 22.16 | |

FIG.33

| | Heat Treatment Conditions | Temperature When Measured (°C) | Residual Magnetic Flux Density Br (kG) | Coercive Force Hcj (kOe) | Maximum Energy Product BHmax (MGOe) | Tensile Strength (MPa) |
|---|---|---|---|---|---|---|
| Example 8-4 | After retained at 1055°C for 3 hours, retained at 910°C for 3 hours and further retained at 500°C for 4 hours | 20 | 13.28 | 21.52 | 42.72 | 112.55 |
| | | 100 | 12.38 | 11.86 | 36.27 | |
| | | 160 | 11.29 | 6.310 | 29.41 | |
| | | 200 | 10.39 | 3.910 | 22.06 | |
| Example 8-5 | After retained at 1055°C for 3 hours, retained at 910°C for 3 hours and further retained at 500°C for 4 hours | 20 | 13.36 | 21.41 | 43.23 | 111.64 |
| | | 100 | 12.37 | 11.88 | 36.29 | |
| | | 160 | 11.33 | 6.320 | 29.75 | |
| | | 200 | 10.39 | 3.830 | 21.80 | |

FIG.35

| Site Name | Element Name | Occupancy | x | y | z |
|---|---|---|---|---|---|
| 4f | Nd | 0.4652720 | 0.3568750 | 0.3578640 | 0.0000000 |
| 4f | Tb | 0.3445180 | 0.3568750 | 0.3578640 | 0.0000000 |
| 4f | Pr | 0.1434780 | 0.3568750 | 0.3578640 | 0.0000000 |
| 4f | Co | 0.0467320 | 0.3568750 | 0.3578640 | 0.0000000 |
| 4g | Nd | 0.8847900 | 0.7709990 | 0.2290010 | 0.0000000 |
| 4g | Tb | 0.0118485 | 0.7709990 | 0.2290010 | 0.0000000 |
| 4g | Pr | 0.0981788 | 0.7709990 | 0.2290010 | 0.0000000 |
| 4e | Fe | 1.0000000 | 0.0000000 | 0.0000000 | 0.1119120 |
| 4c | Fe | 1.0000000 | 0.0000000 | 0.5000000 | 0.0000000 |
| 8j | Fe | 1.0000000 | 0.0991846 | 0.0991846 | 0.2942000 |
| 8j | Fe | 0.8492600 | 0.3163810 | 0.3163810 | 0.2531190 |
| 8j | Co | 0.1507400 | 0.3163810 | 0.3163810 | 0.2531190 |
| 16k | Fe | 1.0000000 | 0.5662120 | 0.2232060 | 0.3725580 |
| 16k | Fe | 0.8309270 | 0.1399630 | 0.5362010 | 0.1759520 |
| 16k | Co | 0.1690730 | 0.1399630 | 0.5362010 | 0.1759520 |
| 4f | B | 0.9012570 | 0.1232060 | 0.1232060 | 0.0000000 |
| 4f | Co | 0.0987430 | 0.1232060 | 0.1232060 | 0.0000000 |

FIG.36

| | Heat Treatment Conditions | Temperature When Measured (°C) | Residual Magnetic Flux Density Br (kG) | Coercive Force Hcj (kOe) | Maximum Energy Product BHmax (MGOe) | Tensile Strength (MPa) |
|---|---|---|---|---|---|---|
| Example 9-1 | After retained at 1055°C for 3 hours, retained at 910°C for 3 hours and further retained at 500°C for 4 hours | 20 | 12.79 | 29.86 | 39.58 | 155.34 |
| | | 100 | 11.83 | 18.25 | 33.64 | |
| | | 160 | 10.87 | 10.79 | 28.13 | |
| | | 200 | 10.00 | 6.580 | 23.04 | |
| Example 9-2 | After retained at 1055°C for 3 hours, retained at 910°C for 3 hours and further retained at 500°C for 4 hours | 20 | 12.76 | 29.68 | 39.38 | 161.07 |
| | | 100 | 11.80 | 18.14 | 33.47 | |
| | | 160 | 10.86 | 10.73 | 28.03 | |
| | | 200 | 10.00 | 6.610 | 23.04 | |
| Example 9-3 | After retained at 1055°C for 3 hours, retained at 910°C for 3 hours and further retained at 500°C for 4 hours | 20 | 12.76 | 29.77 | 39.36 | 118.28 |
| | | 100 | 11.80 | 18.20 | 33.45 | |
| | | 160 | 10.86 | 10.74 | 28.00 | |
| | | 200 | 9.980 | 6.630 | 22.99 | |

FIG.37

| | Heat Treatment Conditions | Temperature When Measured (°C) | Residual Magnetic Flux Density Br (kG) | Coercive Force Hcj (kOe) | Maximum Energy Product BHmax (MGOe) | Tensile Strength (MPa) |
|---|---|---|---|---|---|---|
| Example 9-4 | After retained at 1055°C for 3 hours, retained at 910°C for 3 hours and further retained at 500°C for 4 hours | 20 | 12.79 | 29.79 | 39.58 | 115.24 |
| | | 100 | 11.83 | 18.21 | 33.45 | |
| | | 160 | 10.86 | 10.58 | 28.00 | |
| | | 200 | 10.03 | 6.660 | 23.12 | |
| Example 9-5 | After retained at 1055°C for 3 hours, retained at 910°C for 3 hours and further retained at 500°C for 4 hours | 20 | 12.81 | 29.55 | 39.66 | 133.78 |
| | | 100 | 11.85 | 18.06 | 33.71 | |
| | | 160 | 10.87 | 10.53 | 28.04 | |
| | | 200 | 9.980 | 6.580 | 23.02 | |

FIG.39

| Site Name | Element Name | Occupancy | x | y | z |
|---|---|---|---|---|---|
| 4f | Nd | 0.1810140 | 0.3568750 | 0.3578640 | 0.0000000 |
| 4f | Tb | 0.3541030 | 0.3568750 | 0.3578640 | 0.0000000 |
| 4f | Pr | 0.3921130 | 0.3568750 | 0.3578640 | 0.0000000 |
| 4f | Co | 0.0727701 | 0.3568750 | 0.3578640 | 0.0000000 |
| 4g | Nd | 0.6849490 | 0.7711700 | 0.2288300 | 0.0000000 |
| 4g | Tb | 0.0564924 | 0.7711700 | 0.2288300 | 0.0000000 |
| 4g | Pr | 0.2540990 | 0.7711700 | 0.2288300 | 0.0000000 |
| 4e | Fe | 1.0000000 | 0.0000000 | 0.0000000 | 0.1133880 |
| 4c | Fe | 1.0000000 | 0.0000000 | 0.5000000 | 0.0000000 |
| 8j | Fe | 1.0000000 | 0.0995282 | 0.0995282 | 0.2942000 |
| 8j | Fe | 0.7859750 | 0.3168140 | 0.3168140 | 0.2515540 |
| 8j | Co | 0.2140250 | 0.3168140 | 0.3168140 | 0.2515540 |
| 16k | Fe | 1.0000000 | 0.5693110 | 0.2231130 | 0.3727360 |
| 16k | Fe | 0.7721600 | 0.1394090 | 0.5378460 | 0.1767480 |
| 16k | Co | 0.2278400 | 0.1394090 | 0.5378460 | 0.1767480 |
| 4f | B | 0.9635950 | 0.1344360 | 0.1344360 | 0.0000000 |
| 4f | Co | 0.0364054 | 0.1344360 | 0.1344360 | 0.0000000 |

FIG.40

| | Heat Treatment Conditions | Temperature When Measured (°C) | Residual Magnetic Flux Density Br (kG) | Coercive Force Hcj (kOe) | Maximum Energy Product BHmax (MGOe) | Tensile Strength (MPa) |
|---|---|---|---|---|---|---|
| Example 10-1 | After retained at 1050°C for 3 hours, retained at 910°C for 3 hours and further retained at 500°C for 4 hours | 20 | 12.57 | 32.24 | 38.13 | 158.21 |
| | | 100 | 11.62 | 19.72 | 32.41 | |
| | | 160 | 10.68 | 12.07 | 27.10 | |
| | | 200 | 9.860 | 7.620 | 22.68 | |
| Example 10-2 | After retained at 1050°C for 3 hours, retained at 910°C for 3 hours and further retained at 500°C for 4 hours | 20 | 12.53 | 32.93 | 37.89 | 118.78 |
| | | 100 | 11.61 | 20.13 | 32.20 | |
| | | 160 | 10.65 | 12.51 | 26.96 | |
| | | 200 | 9.800 | 7.990 | 22.55 | |
| Example 10-3 | After retained at 1050°C for 3 hours, retained at 910°C for 3 hours and further retained at 500°C for 4 hours | 20 | 12.55 | 32.54 | 37.91 | 145.07 |
| | | 100 | 11.61 | 19.88 | 32.22 | |
| | | 160 | 10.65 | 12.27 | 26.38 | |
| | | 200 | 9.800 | 7.680 | 22.48 | |

FIG.41

| | Heat Treatment Conditions | Temperature When Measured (°C) | Residual Magnetic Flux Density Br (kG) | Coercive Force Hcj (kOe) | Maximum Energy Product BHmax (MGOe) | Tensile Strength (MPa) |
|---|---|---|---|---|---|---|
| Example 10-4 | After retained at 1050°C for 3 hours, retained at 910°C for 3 hours and further retained at 500°C for 4 hours | 20 | 12.58 | 32.34 | 38.06 | 123.50 |
| | | 100 | 11.63 | 19.77 | 32.35 | |
| | | 160 | 10.70 | 12.18 | 27.04 | |
| | | 200 | 9.690 | 7.550 | 21.95 | |
| Example 10-5 | After retained at 1050°C for 3 hours, retained at 910°C for 3 hours and further retained at 500°C for 4 hours | 20 | 12.55 | 32.82 | 38.05 | 123.67 |
| | | 100 | 11.61 | 20.06 | 32.34 | |
| | | 160 | 10.69 | 12.39 | 27.19 | |
| | | 200 | 9.870 | 7.850 | 22.81 | |

FIG.43

| Site Name | Element Name | Occupancy | x | y | z |
|---|---|---|---|---|---|
| 4f | Nd | 0.4278240 | 0.3568750 | 0.3578640 | 0.0000000 |
| 4f | Tb | 0.2960930 | 0.3568750 | 0.3578640 | 0.0000000 |
| 4f | Pr | 0.2125730 | 0.3568750 | 0.3578640 | 0.0000000 |
| 4f | Co | 0.0635103 | 0.3568750 | 0.3578640 | 0.0000000 |
| 4g | Nd | 0.6918740 | 0.7709990 | 0.2290010 | 0.0000000 |
| 4g | Tb | 0.1165680 | 0.7709990 | 0.2290010 | 0.0000000 |
| 4g | Pr | 0.2000510 | 0.7709990 | 0.2290010 | 0.0000000 |
| 4e | Fe | 1.0000000 | 0.0000000 | 0.0000000 | 0.1130510 |
| 4c | Fe | 1.0000000 | 0.0000000 | 0.5000000 | 0.0000000 |
| 8j | Fe | 1.0000000 | 0.0989581 | 0.0989581 | 0.2942000 |
| 8j | Fe | 0.7225840 | 0.3159400 | 0.3159400 | 0.2532600 |
| 8j | Co | 0.2774160 | 0.3159400 | 0.3159400 | 0.2532600 |
| 16k | Fe | 1.0000000 | 0.5662250 | 0.2239150 | 0.3718390 |
| 16k | Fe | 0.8393050 | 0.1401490 | 0.5373710 | 0.1758790 |
| 16k | Co | 0.1606950 | 0.1401490 | 0.5373710 | 0.1758790 |
| 4f | B | 0.9169340 | 0.1243320 | 0.1243320 | 0.0000000 |
| 4f | Co | 0.0830661 | 0.1243320 | 0.1243320 | 0.0000000 |

FIG.44

| | Heat Treatment Conditions | Temperature When Measured (°C) | Residual Magnetic Flux Density Br (kG) | Coercive Force Hcj (kOe) | Maximum Energy Product BHmax (MGOe) |
|---|---|---|---|---|---|
| Example 11 | After retained at 1040°C for 5 hours, retained at 910°C for 3 hours and further retained at 490°C for 4 hours | 20 | 11.45 | 47.19 | 31.46 |
| | | 100 | 10.67 | 32.38 | 27.15 |
| | | 160 | 9.82 | 22.53 | 23.00 |
| | | 200 | 9.05 | 19.30 | 19.49 |
| Example 12 | After retained at 1040°C for 5 hours, retained at 910°C for 3 hours and further retained at 490°C for 4 hours | 20 | 13.27 | 28.04 | 42.05 |
| | | 100 | 12.16 | 17.75 | 35.77 |
| | | 160 | 11.13 | 10.63 | 29.79 |
| | | 200 | 10.29 | 6.70 | 25.21 |

FIG.45

| | Powder Particle Size (μm) | Sintered Particle Size (μm) | Heat Treatment Conditions | Temperature When Measured (°C) | Residual Magnetic Flux Density Br (kG) | Coercive Force Hcj (kOe) | Maximum Energy Product BHmax (MGOe) |
|---|---|---|---|---|---|---|---|
| Example 13-1 | 6.0 | 10.7 | After retained at 1055°C for 3 hours, retained at 910°C for 3 hours and further retained at 500°C for 4 hours | 20 | 13.00 | 29.02 | 40.69 |
| | | | | 100 | 11.90 | 18.11 | 33.89 |
| | | | | 160 | 10.90 | 11.08 | 28.31 |
| Example 13-2 | 5.3 | 8.8 | After retained at 1040°C for 3 hours, retained at 910°C for 3 hours and further retained at 500°C for 4 hours | 20 | 12.84 | 29.83 | 39.75 |
| | | | | 100 | 10.84 | 18.79 | 33.21 |
| | | | | 160 | 9.970 | 11.75 | 27.90 |
| | | | | 200 | 12.90 | 7.570 | 23.25 |
| Example 13-3 | 3.5 | 4.8 | After retained at 1000°C for 3 hours, retained at 910°C for 3 hours and further retained at 500°C for 4 hours | 20 | 12.37 | 30.55 | 37.18 |
| | | | | 100 | 11.43 | 19.25 | 31.50 |
| | | | | 160 | 10.47 | 12.20 | 26.19 |
| | | | | 200 | 10.02 | 7.620 | 23.57 |

FIG.46

| | Powder Particle Size (μm) | Sintered Particle Size (μm) | Heat Treatment Conditions | Temperature When Measured (°C) | Residual Magnetic Flux Density Br (kG) | Coercive Force Hcj (kOe) | Maximum Energy Product BHmax (MGOe) |
|---|---|---|---|---|---|---|---|
| Example 13-4 | 5.3 | Un-measured | After retained at 1000°C for 3 hours, retained at 910°C for 3 hours and further retained at 500°C for 4 hours | 20 | 11.98 | 29.72 | 34.16 |
| | | | | 100 | 10.86 | 17.75 | 17.95 |
| | | | | 160 | 9.930 | 10.95 | 13.74 |
| | | | | 200 | 9.140 | 6.940 | 10.23 |
| Example 13-5 | 5.3 | Un-measured | After retained at 1020°C for 3 hours, retained at 910°C for 3 hours and further retained at 500°C for 4 hours | 20 | 12.74 | 29.00 | 39.15 |
| | | | | 100 | 11.70 | 17.99 | 32.85 |
| | | | | 160 | 10.75 | 11.16 | 27.10 |
| | | | | 200 | 9.970 | 7.130 | 23.01 |
| Example 13-6 | 5.3 | Un-measured | After retained at 1030°C for 3 hours, retained at 910°C for 3 hours and further retained at 500°C for 4 hours | 20 | 12.72 | 29.58 | 38.97 |
| | | | | 100 | 11.74 | 18.48 | 32.92 |
| | | | | 160 | 10.76 | 10.58 | 27.51 |
| | | | | 200 | 10.01 | 7.900 | 23.46 |

FIG. 47

| | Powder Particle Size (μm) | Sintered Particle Size (μm) | Heat Treatment Conditions | Temperature When Measured (°C) | Residual Magnetic Flux Density Br (kG) | Coercive Force Hcj (kOe) | Maximum Energy Product BHmax (MGOe) |
|---|---|---|---|---|---|---|---|
| Mixture of Example 13 and Example 14 | 5.0 | 7.7 | After retained at 1025°C for 3 hours, retained at 910°C for 3 hours and further retained at 500°C for 4 hours | 20 | 12.81 | 31.17 | 39.59 |
| | | | | 100 | 11.85 | 19.05 | 33.65 |
| | | | | 160 | 10.87 | 11.60 | 28.01 |
| | | | | 200 | 10.03 | 7.470 | 23.53 |

FIG.48

| | Heat Treatment Conditions | |
|---|---|---|
| Comparative Example 1-1 | Retained at 1055°C for 3 hours | Non-contraction |
| Comparative Example 1-2 | Retained at 1075°C for 3 hours | Non-contraction |
| Comparative Example 1-3 | Retained at 1060°C for 3 hours | Non-contraction |
| Comparative Example 1-4 | Retained at 1105°C for 3 hours | Burnt when taken out of furnace |
| Comparative Example 1-5 | Retained at 1120°C for 3 hours | Non-contraction |
| Comparative Example 2-1 | Retained at 1055°C for 3 hours | Non-contraction |
| Comparative Example 2-2 | Retained at 1075°C for 3 hours | Non-contraction |
| Comparative Example 2-3 | Retained at 1060°C for 3 hours | Non-contraction |
| Comparative Example 2-4 | Retained at 1105°C for 3 hours | Incompletely Contracted |
| Comparative Example 2-5 | Retained at 1120°C for 3 hours | Contracted, but section of base material is abnormal and has taken on bright silver color |

RARE EARTH PERMANENT MAGNET AND RARE EARTH PERMANENT MAGNET MANUFACTURING METHOD

TECHNICAL FIELD

The present disclosure relates to a rare earth permanent magnet containing neodymium, iron, and boron.

BACKGROUND ART

As a technique to enhance a magnet property of a rare earth permanent magnet containing neodymium (Nd), iron (Fe), and boron (B), there is a magnet in which Fe is substituted with Co (PTL 1). PTL 1 describes that a coercive force Hc, residual magnetic flux density Br, maximum energy product $BH_{max}$, and so on of permanent magnets in which Fe is substituted with other atoms were measured exhaustively, thereby showing enhancement of the magnetic property of the above-described permanent magnet.

Furthermore, PTL 2 discloses a rare earth sintered magnet that contains, by percent by weight: R (where R is at least one type of rare earth elements including Y and Nd accounts for 50 atom % or more of R): 25 to 35%; B: 0.8 to 1.5%; M (at least one type selected from Ti, Cr, Ga, Mn, Co, Ni, Cu, Zn, Nb, and Al) when necessary: 8% or less; and the remainder T (Fe or Fe and Co).

As another suggestion to enhance the magnetic property of the rare earth permanent magnet, there is a nanocomposite magnet having a two-phase composite structure in which a hard magnet phase of nanoparticles consisting of Nd, Fe, and B forms a core and a soft magnet phase of specified nanoparticles forms a shell. Regarding the above-mentioned nanocomposite magnet, particularly when the shell is formed by covering the core with a grain boundary composed of very fine particles of a soft magnetic substance whose particle size is 5 nm or less, a good exchange interaction occurs between the hard magnet phase and the soft magnet phase, that is, the core and the shell, thereby making it possible to enhance saturation magnetization.

PTL 3 discloses a nanocomposite magnet in which $Nd_2Fe_{14}B$ compound particles form a core and Fe particles form a shell. The saturation magnetization of the nanocomposite magnet is further enhanced by using FeCo alloy nanoparticles which exhibit high saturation magnetization as a shell constituent. PTL 4 discloses a nanocomposite magnet in which a core of an NdFeB hard magnet phase is covered with a shell of an FeCo soft magnet phase.

PTL 5 discloses an anisotropy bulk nanocomposite rare earth permanent magnet regarding which a composition of a magnetically hard phase as defined by atom percentage is $R_xT_{100-x-y}M_y$ (where in this expression, R is selected from rare earths, yttrium, scandium, or a combination of these elements; T is selected from one or more types of transition metals; M is selected from elements of group IIIA, elements of group IVA, elements of group VA, or a combination of these elements; x is larger than a stoichiometric amount of R in a corresponding rare-earth transition-metal compound; and y is 0 to approximately 25) and at least one type of a magnetically-soft phase includes at least one type of a soft magnetic material containing Fe, Co, or N.

However, with the nanocomposite rare earth permanent magnet disclosed in PTL 5, a soft phase is formed by a metallurgical method. Accordingly, the particle size of particles which form the soft phase is large. So, there is a possibility that a sufficient exchange interaction may not be obtained. Furthermore, if reducing power is weak, alloy nanoparticles tend to easily become just an aggregate of single-layer nanoparticles and a desired nanocomposite structure cannot be obtained. Therefore, it is presumed that the magnetic property of the above-described nanocomposite rare earth permanent magnet may not be enhanced effectively.

NPL 1 discloses a method for manufacturing FeCo nanoparticles at a high temperature. However, a coercive force $H_{cj}$ of the relevant $Nd_2Fe_{14}B$ particles manufactured at a high temperature is not good.

CITATION LIST

Patent Literature

PTL 1: U.S. Pat. No. 5,645,651
PTL 2: Japanese Patent Application Laid-Open (Kokai) Publication No. 2003-217918
PTL 3: Japanese Patent Application Laid-Open (Kokai) Publication No. 2008-117855
PTL 4: Japanese Patent Application Laid-Open (Kokai) Publication No. 2010-74062
PTL 5: Japanese Unexamined Patent Application Publication (Translation of PCT Application) No. 2008-505500

Non-Patent Literature

NPL 1: G. S. Chaubey, J. P. Liu et al., J. Am. Chem. Soc. 129, 7214 (2007)

SUMMARY

Technical Problem

However, there is a further demand for enhancement of the magnetic property of the rare earth permanent magnet. It is an object of the present disclosure to enhance the magnetic property of the rare earth permanent magnet whose main phase is a compound containing Nd, Fe, and B.

Solution to Problem

As a result of earnest examinations of constituent atoms of $Nd_2Fe_{14}B$ particles in order to achieve the above-described object, the inventors of the present disclosure conceived the idea of enhancing a magnetic moment of neodymium atoms in the $Nd_2Fe_{14}B$ particles, thereby enhancing the magnetic property of the permanent magnet. Specifically speaking, the inventors conceived the idea of further enhancing the magnetic moment of the above-mentioned neodymium atoms by substituting boron contained in $Nd_2Fe_{14}B$ particles with other atoms.

In addition, a function effect of a case where other atoms which can be substituted for boron are contained in the particles was examined. As a result, they found the possibility of further enhancing the magnetic moment of the relevant particles as such other atoms are substituted for iron.

The inventors of the present disclosure advanced the examinations and found that the coercive force $H_{cj}$ can be enhanced by forming a grain boundary phase in the $Nd_2Fe_{14}B$ particles. The inventors of the present disclosure have completed the present disclosure on the basis of the above conceived ideas and findings.

The present disclosure is a rare earth permanent magnet with a compound represented by an expression (1) indicated below as a main phase. In the expression (1), M represents an element selected from any one of cobalt, beryllium, lithium, aluminum, and silicon and x is a value that satisfies $0.01 \leq x \leq 0.25$, and more preferably $0.02 \leq x \leq 0.25$.

[Chem. 1]

$$Nd_2Fe_{14}B_{(1-x)}M_x \quad (1)$$

The present disclosure includes a rare earth permanent magnet with a compound represented by an expression (2) indicated below as a main phase. In the expression (2), M and L are elements selected from any one of cobalt, beryllium, lithium, aluminum, and silicon, y is $0<y<2$, x is $0.01 \leq x \leq 0.25$, and x and y satisfy $0.01<(x+y)<2.25$. More preferably, y is $0.1<y<1.2$, x is $0.02 \leq x \leq 0.25$, and x and y satisfy $0.12<(x+y)<1.45$.

[Chem. 2]

$$Nd_2Fe_{(14-y)}L_yB_{(1-x)}M_x \quad (2)$$

The present disclosure is a rare earth permanent magnet whose main phase has an Nd—Fe—B layer and an Fe layer periodically and part of boron contained in the Nd—Fe—B layer is substituted with any one or more types of elements selected from a group consisting of cobalt, beryllium, lithium, aluminum, and silicon.

The above-mentioned Nd—Fe—B layer should preferably contain terbium. Furthermore, the Nd—Fe—B layer should preferably contain any one or more types of elements of praseodymium and dysprosium.

From another point of view, the present disclosure is a rare earth permanent magnet including a main phase containing neodymium, iron, and boron and further containing any one or more types of elements selected from a group consisting of cobalt, beryllium, lithium, aluminum, and silicon. A content of neodymium is 20 to 35 wt %, a content of boron is 0.80 to 0.99 wt %, and a total content of any one or more types of elements selected from a group consisting of cobalt, beryllium, lithium, aluminum, and silicon relative to a total weight of the rare earth permanent magnet of the present disclosure.

The present disclosure includes a rare earth permanent magnet further containing terbium. In that case, it is preferable that the content of neodymium should be 20 to 35 wt %, the content of boron should be 0.80 to 0.99 wt %, the total content of any one or more types of elements selected from a group consisting of cobalt, beryllium, lithium, aluminum, and silicon should be 0.8 to 1.0 wt %, and the content of terbium should be 2.0 to 10.0 wt % relative to the total weight of the rare earth permanent magnet of the present disclosure.

The present disclosure includes a rare earth permanent magnet equipped with a main phase further containing any one or more types of elements of praseodymium and dysprosium. It is preferable that the content of neodymium should be 15 to 40 wt %, the content of praseodymium should be 5 to 20 wt %, the content of boron should be 0.80 to 0.99 wt %, the total content of any one or more types of elements selected from a group consisting of cobalt, beryllium, lithium, aluminum, and silicon should be 0.8 to 1.0 wt %, and the content of terbium should be 2.0 to 10.0 wt % relative to the total weight of the rare earth permanent magnet containing the praseodymium.

The present disclosure includes a rare earth permanent magnet including the above-described main phase and a grain boundary phase containing any one or more types of elements selected from a group consisting of aluminum, copper, niobium, zirconium, titanium, and gallium. The grain boundary phase should preferably contain at least 0.1 to 0.4% aluminum and 0.01 to 0.1% copper by percent by weight.

According to the present disclosure, the main phase should preferably contain a crystal containing neodymium, iron, boron and containing any one or more types of elements selected from a group consisting of cobalt, beryllium, lithium, aluminum, and silicon, and a sintered particle size $D_{50}$ of the crystal be 2 to 25 μm. Furthermore, a sintered density of the rare earth permanent magnet of the present disclosure should preferably be 6 to 8 g/cm$^3$.

The present disclosure containing neodymium, iron, and boron, further containing any one or more types of elements selected from a group consisting of cobalt, beryllium, lithium, aluminum, and silicon, and containing terbium has a magnetic property that satisfies any one or more conditions of a group consisting of mc1 and mc2 mentioned below at a temperature condition of 20° C. Mc1 represents the magnetic property indicating that a residual magnetic flux density Br is 12.90 kG or more. Mc2 represents the magnetic property indicating that a coercive force $H_{cj}$ is 27.90 kOe or more.

The present disclosure containing the above-mentioned elements has a magnetic property that satisfies any one or more conditions of a group consisting of mc3 and mc4 mentioned below at a temperature condition of 100° C. Mc3 represents the magnetic property indicating that the residual magnetic flux density Br is 11.80 kG or more. Mc4 represents the magnetic property indicating that the coercive force $H_{cj}$ is 17.40 kOe or more.

The present disclosure containing the above-mentioned elements has a magnetic property that satisfies any one or more conditions of a group consisting of mc5 and mc6 mentioned below at a temperature condition of 160° C. Mc5 represents the magnetic property indicating that the residual magnetic flux density Br is 10.80 kG or more. Mc6 represents the magnetic property indicating that the coercive force $H_{cj}$ is 10.50 kOe or more.

The present disclosure containing the above-mentioned elements has a magnetic property that satisfies any one or more conditions of a group consisting of mc7 and mc8 mentioned below at a temperature condition of 200° C. Mc7 represents the magnetic property indicating that the residual magnetic flux density Br is 10.10 kG or more. Mc8 represents the magnetic property indicating that the coercive force $H_{cj}$ is 6.60 kOe or more.

The present disclosure containing neodymium, iron, and boron, further containing any one or more types of elements selected from a group consisting of cobalt, beryllium, lithium, aluminum, and silicon, and containing terbium, and additionally containing any one or more types of elements of praseodymium and dysprosium has a magnetic property that satisfies any one or more conditions of a group consisting of mc9 and mc10 mentioned below at a temperature condition of 20° C. Mc9 represents the magnetic property indicating that the residual magnetic flux density Br is 12.50 kG or more. Mc10 represents the magnetic property indicating that the coercive force $H_{cj}$ is 21.20 kOe or more.

The present disclosure containing the above-mentioned elements has a magnetic property that satisfies any one or more conditions of a group consisting of mc11 and mc12 mentioned below at a temperature condition of 100° C. Mc11 represents the magnetic property indicating that the residual magnetic flux density Br is 11.60 kG or more. Mc12 represents the magnetic property indicating that the coercive force $H_{cj}$ is 11.80 kOe or more.

The present disclosure containing the above-mentioned elements has a magnetic property that satisfies any one or more conditions of a group consisting of mc13 and mc14 mentioned below at a temperature condition of 160° C. Mc13 represents the magnetic property indicating that the residual magnetic flux density Br is 10.60 kG or more. Mc14 represents the magnetic property indicating that the coercive force $H_{cj}$ is 6.20 kOe or more.

The present disclosure containing the above-mentioned elements has a magnetic property that satisfies any one or more conditions of a group consisting of mc15 and mc16 mentioned below at a temperature condition of 200° C. Mc15 represents the magnetic property indicating that the residual magnetic flux density Br is 9.60 kG or more. Mc16 represents the magnetic property indicating that the coercive force $H_{cj}$ is 3.80 kOe or more.

The present disclosure containing the above-specified main phase and any one or more types of elements selected from a group consisting of aluminum, copper, niobium, zirconium, titanium, and gallium has a magnetic property that satisfies any one or more conditions of a group consisting of mc17 and mc18 mentioned below at a temperature condition of 20° C. Mc17 represents the magnetic property indicating that the residual magnetic flux density Br is 11.40 kG or more. Mc18 represents the magnetic property indicating that the coercive force $H_{cj}$ is 28.00 kOe or more.

The present disclosure containing the above-mentioned elements has a magnetic property that satisfies any one or more conditions of a group consisting of mc19 and mc20 mentioned below at a temperature condition of 100° C. Mc19 represents the magnetic property indicating that the residual magnetic flux density Br is 10.60 kG or more. Mc20 represents the magnetic property indicating that the coercive force $H_{cj}$ is 17.70 kOe or more.

The present disclosure containing the above-mentioned elements has a magnetic property that satisfies any one or more conditions of a group consisting of mc21 and mc22 mentioned below at a temperature condition of 160° C. Mc21 represents the magnetic property indicating that the residual magnetic flux density Br is 9.80 kG or more. Mc22 represents the magnetic property indicating that the coercive force $H_{cj}$ is 10.60 kOe or more.

The present disclosure containing the above-mentioned elements has a magnetic property that satisfies any one or more conditions of a group consisting of mc23 and mc24 mentioned below at a temperature condition of 200° C. Mc23 represents the magnetic property indicating that the residual magnetic flux density Br is 9.00 kG or more. Mc24 represents the magnetic property indicating that the coercive force $H_{cj}$ is 6.70 kOe or more.

Tensile strength of the rare earth permanent magnet according to the present disclosure is 80 MPa or more, preferably 100 MPa or more, and more preferably 150 MPa or more.

The present disclosure includes a rare earth permanent magnet manufacturing method. Specifically speaking, the rare earth permanent magnet manufacturing method includes a heat treatment step of: retaining a raw material compound which contains neodymium, iron, and boron, contains any one or more types of elements selected from a group consisting of cobalt, beryllium, lithium, aluminum, and silicon, contains terbium, and contains any one or more types of elements selected from a group consisting of aluminum, copper, niobium, zirconium, titanium, and gallium, at a main-phase-forming temperature and then lowering the main-phase-forming temperature to a grain-boundary-phase-forming temperature, thereby forming a main phase containing neodymium, iron, and boron, containing any one or more types of elements selected from a group consisting of cobalt, beryllium, lithium, aluminum, and silicon, and containing terbium; and further retaining the raw material compound at the grain-boundary-phase-forming temperature, thereby forming a grain boundary phase containing any one or more types of elements selected from a group consisting of aluminum, copper, niobium, zirconium, titanium, and gallium.

The present disclosure includes the rare earth permanent magnet manufacturing method including the heat treatment step of: retaining a raw material compound which contains neodymium, praseodymium, iron, and boron, contains any one or more types of elements selected from a group consisting of cobalt, beryllium, lithium, aluminum, and silicon, contains any one or more types of elements of terbium and dysprosium, and contains any one or more types of elements selected from a group consisting of aluminum, copper, niobium, zirconium, titanium, and gallium, at the main-phase-forming temperature and then lowering the main-phase-forming temperature to the grain-boundary-phase-forming temperature, thereby forming the main phase containing neodymium, praseodymium, iron, and boron, and further containing any one or more types of elements selected from a group consisting of cobalt, beryllium, lithium, aluminum, and silicon, and containing any one or more types of elements of terbium and dysprosium; and retaining the raw material compound at the grain-boundary-phase-forming temperature, thereby forming the grain boundary phase containing any one or more types of elements selected from a group consisting of aluminum, copper, niobium, zirconium, titanium, and gallium.

In the heat treatment step, the raw material compound should preferably be retained at 1000 to 1200° C. for 3 to 5 hours, then retained at 880 to 920° C. for 4 to 5 hours, and then retained at 480 to 520° C. for 3 to 5 hours.

Advantageous Effects

The present disclosure can enhance the magnetic moment by using a compound having the above-described specified crystal structure as a main phase. As a result, the coercive force $H_{cj}$, the residual magnetic flux density Br, and the maximum energy product $BH_{max}$ of the rare earth permanent magnet of the present disclosure are enhanced.

BRIEF DESCRIPTION OF DRAWINGS

FIG. 4 is a diagram illustrating the electron density of states of the crystal of $Nd_2Fe_{14}B$ particles;

FIG. 5 is a diagram illustrating the electron density of states of the crystal of $Nd_2Fe_{14}B$ particles;

FIG. 7 is a composition chart of Examples and Comparative Examples of the present disclosure;

FIG. 8 is a chart showing the magnetic property of examples of the present disclosure;

FIG. 9 is a chart showing the magnetic property of examples of the present disclosure;

FIG. 10 is a chart showing the magnetic property of examples of the present disclosure;

FIG. 27 is an analysis result of the crystal structure by the Rietveld method according to an example of the present disclosure;

FIG. 28 is a chart showing the magnetic property of examples of the present disclosure;

FIG. 29 is a chart showing the magnetic property of examples of the present disclosure;

FIG. 31 is an analysis result of the crystal structure by the Rietveld method according to an example of the present disclosure;

FIG. 32 is a chart showing the magnetic property of examples of the present disclosure;

FIG. 33 is a chart showing the magnetic property of examples of the present disclosure;

FIG. 35 is an analysis result of the crystal structure by the Rietveld method according to an example of the present disclosure;

FIG. 36 is a chart showing the magnetic property of examples of the present disclosure;

FIG. 37 is a chart showing the magnetic property of examples of the present disclosure;

FIG. 39 is an analysis result of the crystal structure by the Rietveld method according to an example of the present disclosure;

FIG. 40 is a chart showing the magnetic property of examples of the present disclosure;

FIG. 41 is a chart showing the magnetic property of examples of the present disclosure;

FIG. 43 is an analysis result of the crystal structure by the Rietveld method according to an example of the present disclosure;

FIG. 44 is a chart showing the magnetic property of examples of the present disclosure;

FIG. 45 is a chart showing the magnetic property of examples of the present disclosure;

FIG. 46 is a chart showing the magnetic property of examples of the present disclosure;

FIG. 47 is a chart showing the magnetic property of examples of the present disclosure; and FIG. 48 is a chart showing the state after a heat treatment in Comparative Examples of the present disclosure.

DESCRIPTION OF EMBODIMENTS

Examinations on the crystal of the $Nd_2Fe_{14}B$ particles by the inventors of the present disclosure will be described in order to explain the present disclosure. The inventors of the present disclosure calculated the magnetic moment of the $Nd_2Fe_{14}B$ particles by the first-principles pseudopotential method using a plane wave basis and obtained the results illustrated in FIG. 3 to FIG. 5. Incidentally, in the following description, FIG. 3(*a*) indicates a left graph of FIG. 3, FIG. 3(*b*) indicates a right graph of FIG. 3, FIG. 4(*a*) indicates a left graph of FIG. 4, FIG. 4(*b*) indicates a right graph of FIG. 4, FIG. 5(*a*) indicates a left graph of FIG. 5, and FIG. 5(*b*) indicates a right graph of FIG. 5, respectively.

Figure 3:
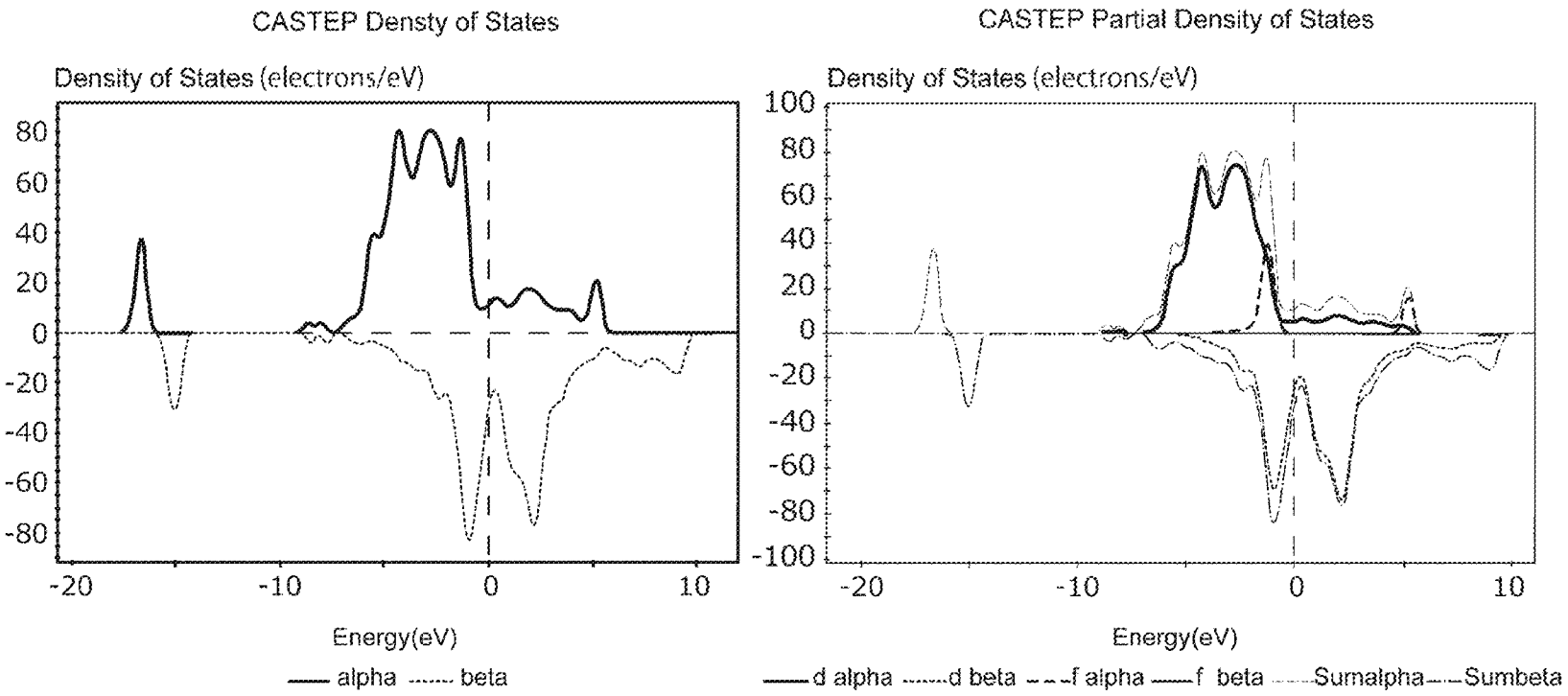
FIG. 3 is a diagram illustrating an electron density of states of a crystal of $Nd_2Fe_{14}B$ particles.

FIG. 3(*a*) is a diagram illustrating an electron density of states of the whole crystal of the $Nd_2Fe_{14}B$ particles obtained by the inventors of the present disclosure. FIG. 3(*b*) is a diagram illustrating a partial electron density of states at d orbitals and f orbitals of entire Fe atoms and Nd atoms in the relevant crystal. Waveforms of the electron density of states indicated in FIG. 3(*a*) and FIG. 3(*b*) are closely similar to each other. Fe accounts for approximately 70 at % of the $Nd_2Fe_{14}B$ particles. Magnetism of the $Nd_2Fe_{14}B$ particles derives from Fe and it is believed that Nd contributes to magnetic expression of the particles by aligning a spin direction of Fe. The results of FIG. 3(*a*) and FIG. 3(*b*) coincide with the above-described findings.

FIG. 4(*a*) is a diagram illustrating a sum of partial electron density of states of s orbitals, p orbitals, and d orbitals of B—Fe nearest neighbor atoms in the $Nd_2Fe_{14}B$ particles obtained by the inventors of the present disclosure. FIG. 4(*b*) is a diagram illustrating a partial electron density of states at the p orbitals and d orbitals of the B—Fe nearest neighbor atoms. According to calculation by first principle calculation software CASTEP (made by Accelrys), the distance between the above-mentioned B and Fe nearest neighbor atoms was 2.09 Å. It was confirmed by referring to FIG. 4(*b*) that the p orbitals of boron were polarized.

Furthermore, the inventors of the present disclosure calculated a local electron density of states at s orbitals and p orbitals of B atoms in the $Nd_2Fe_{14}B$ particles and obtained the results shown in FIG. 5(*a*) and FIG. 5(*b*). It was confirmed by referring to FIG. 5(*a*) and FIG. 5(*b*) that the B atoms were polarized at both the s orbitals and the p orbitals.

Conventionally, it is believed that the boron in the $Nd_2Fe_{14}B$ particles is involved in stabilization of the crystal structure. However, the above-described results of FIG. 4 and FIG. 5 not only suggest the stabilization of the crystal structure by the B atoms, but also the involvement in the magnetic expression of the $Nd_2Fe_{14}B$ particles.

Table 1 is a table of magnetic moments calculated based on atomic locations obtained by a neutron diffraction method (O. Isnard et. al J. Appl. Phys. 78 (1995) 1892-1898). Table 1 shows that the magnetic moment of the ND atoms in the $Nd_2Fe_{14}B$ particles is less than $4\mu_B$ and the magnetic moment is small. It is presumed that one of the reasons for such reduction of the magnetic moment would be covalent bondings between the Nd atoms and the B atoms in the crystal structure of the relevant particles and donation of part of f electrons in the Nd atoms to the s orbitals of the boron atoms. As a result, it is believed that the Nd atoms in the particles lose their magnetism.

TABLE 1

| | Atomic Location When Lattice Constant Is Normalized Fractional atomic positions | | | Magnetic Moment of $Nd_2Fe_{14}B$ ($\mu_B$) |
|---|---|---|---|---|
| Site | x | y | z | $Nd_2Fe_{14}B$ |
| Nd(1) | 0.1415 | 0.1415 | 0 | 2.62 |
| Nd(2) | −0.2687 | 0.2687 | 0 | 2.58 |
| Fe(1) | 0 | 0.5 | 0 | 2.74 |
| Fe(2) | 0.7235 | 0.0671 | 0.3731 | 2.56 |
| Fe(3) | 0.4621 | 0.1413 | 0.3237 | 2.64 |
| Fe(4) | 0.1826 | 0.1826 | 0.2535 | 2.86 |
| Fe(5) | 0.4021 | 0.4021 | 0.2951 | 2.66 |
| Fe(6) | 0 | 0 | 0.3856 | 2.38 |
| B | 0.3757 | 0.3757 | 0 | −0.16 |

Through the above-described examinations, the inventors of the present disclosure obtained findings that the B atoms are polarized and are involved in suppression of magnetism of the $Nd_2Fe_{14}B$ particles. Based on such findings, the inventors of the present disclosure conceived the idea of enhancing the magnetism of the particles by substituting the B atoms with other atoms in the crystal of the $Nd_2Fe_{14}B$ particles.

The rare earth permanent magnet of the present disclosure has a compound represented by an expression (1) indicated below as a main phase. According to the present disclosure, the number of atoms in the relevant compound in a unit lattice accounts for 90 to 98 at % of the number of atoms of the entire particles. However, as long as the function effect of the present disclosure is obtained, the present disclosure permits the main phase to contain impurities which are not the above-described compound.

[Chem. 3]

$$Nd_2Fe_{14}B_{(1-x)}M_x \quad (1)$$

In the expression (1), M represents an element selected from any one of cobalt, beryllium, lithium, aluminum, and silicon. Furthermore, x satisfies $0.01 \le x \le 0.25$, and more preferably $0.03 \le x \le 0.25$.

The present disclosure is composed so that part of boron in the conventional $Nd_2Fe_{14}B$ crystal is substituted with a specified element. Accordingly, the present disclosure can inhibit transfer of f electrons of neodymium to other atoms. Therefore, the number of unpaired electrons of neodymium can be easily maintained and the magnetic moment of the Nd atoms can be enhanced as compared to the conventional crystal. In the expression (1), in a case of $x<0.01$, the magnetic moment reduces. In a case of $x>0.25$, the crystal structure cannot be maintained, so that synthesis cannot be performed.

The present disclosure is designed so that part of boron contained in the main phase is substituted with one or more atoms selected from a group consisting of cobalt, beryllium, lithium, aluminum, and silicon. Accordingly, the present disclosure inhibits reduction of unpaired electrons and enhances the magnetic property.

The present disclosure may be composed so that part of boron and part of iron in the conventional $Nd_2Fe_{14}B$ crystal are substituted with a specified element. Such a composition can be represented by the following expression (2).

[Chem. 4]

$$Nd_2Fe_{(14-y)}L_yB_{(1-x)}M_x \quad (2)$$

In the expression (2), M and L are elements selected from any one of cobalt, beryllium, lithium, aluminum, and silicon, y is $0<y<2$, x is $0.0 \le x \le 0.25$, and x and y satisfy $0.01<(x+y)<2.25$. More preferably, y is $0.1<y<1.2$, x is $0.02 \le x \le 0.25$, and x and y satisfy $0.12<(x+y)<1.45$.

Also in this case, the magnetic moment of the Nd atoms can be enhanced as compared to the conventional crystal. Furthermore, the magnetic moment of the Fe atoms can be enhanced based on conventionally-known findings. In the expression (2), in a case of the magnetic moment of the iron atoms reduces. In a case of $x<0.01$ or $x>0.25$, the magnetic moment of the neodymium atoms reduces. When x, y, and x+y are out of their respective specified ranges, the magnetic moments of the iron atoms and the neodymium atoms reduce.

Since the compound of the main phase according to the present disclosure has the composition represented by the expression (1) or the expression (2), the magnetic moment of the Nd atoms contained in that compound is larger than the magnetic moment of the Nd atoms in the $Nd_2Fe_{14}B$ crystal. The magnetic moment of the Nd atoms according to the present disclosure is at least larger than $2.70\mu_B$ and should preferably be 3.75 to $3.85\mu_B$, and more preferably 3.80 to $3.85\mu_B$.

Specifically, the present disclosure is designed to cause the magnetism of the Nd atoms to be expressed, it has a better magnetic property than magnetism derived from the Fe atoms and the Nd atoms. The magnetic property of the present disclosure can be evaluated based on the coercive force $H_{cj}$ and the residual magnetic flux density Br. The magnetic property of the present disclosure is enhanced by 40 to 50% as compared to the rare earth permanent magnet composed of the conventional $Nd_2Fe_{14}B$ crystal.

Figure 1:
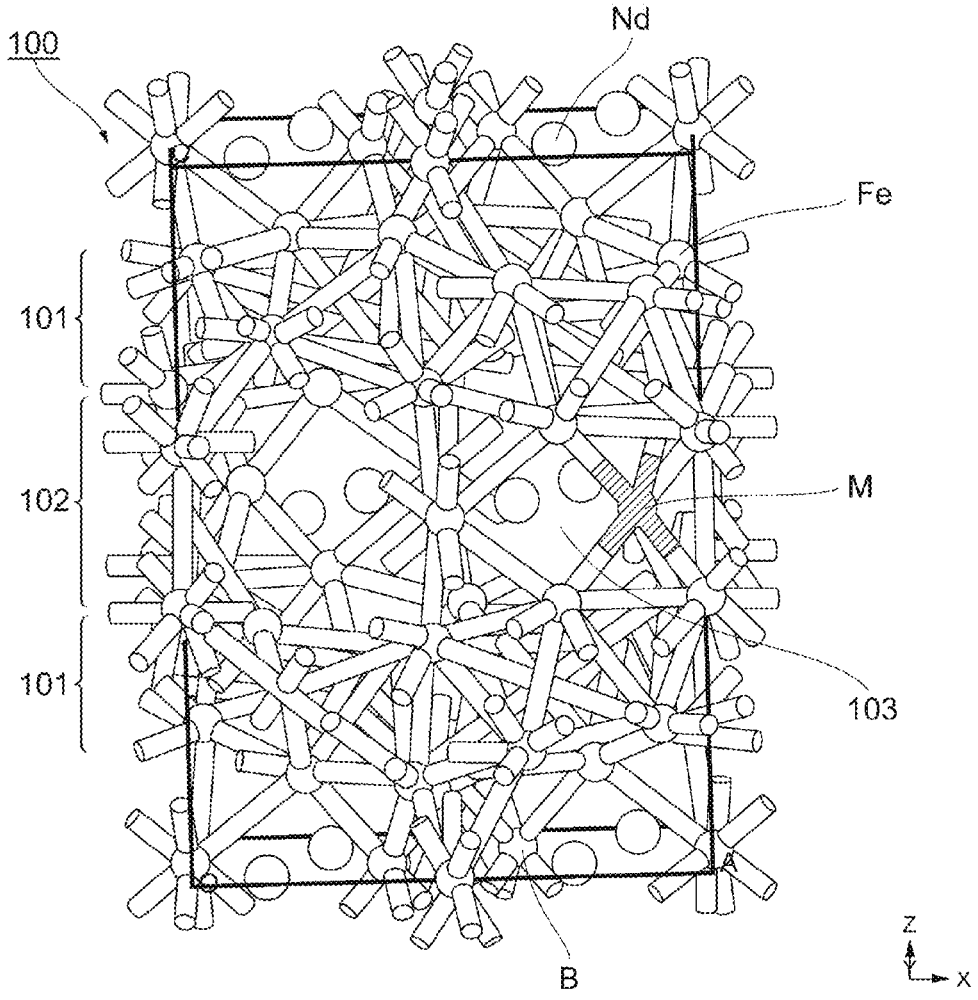
FIG. 1 is a schematic view illustrating an example of a crystal structure of the present disclosure.
Figure 2:
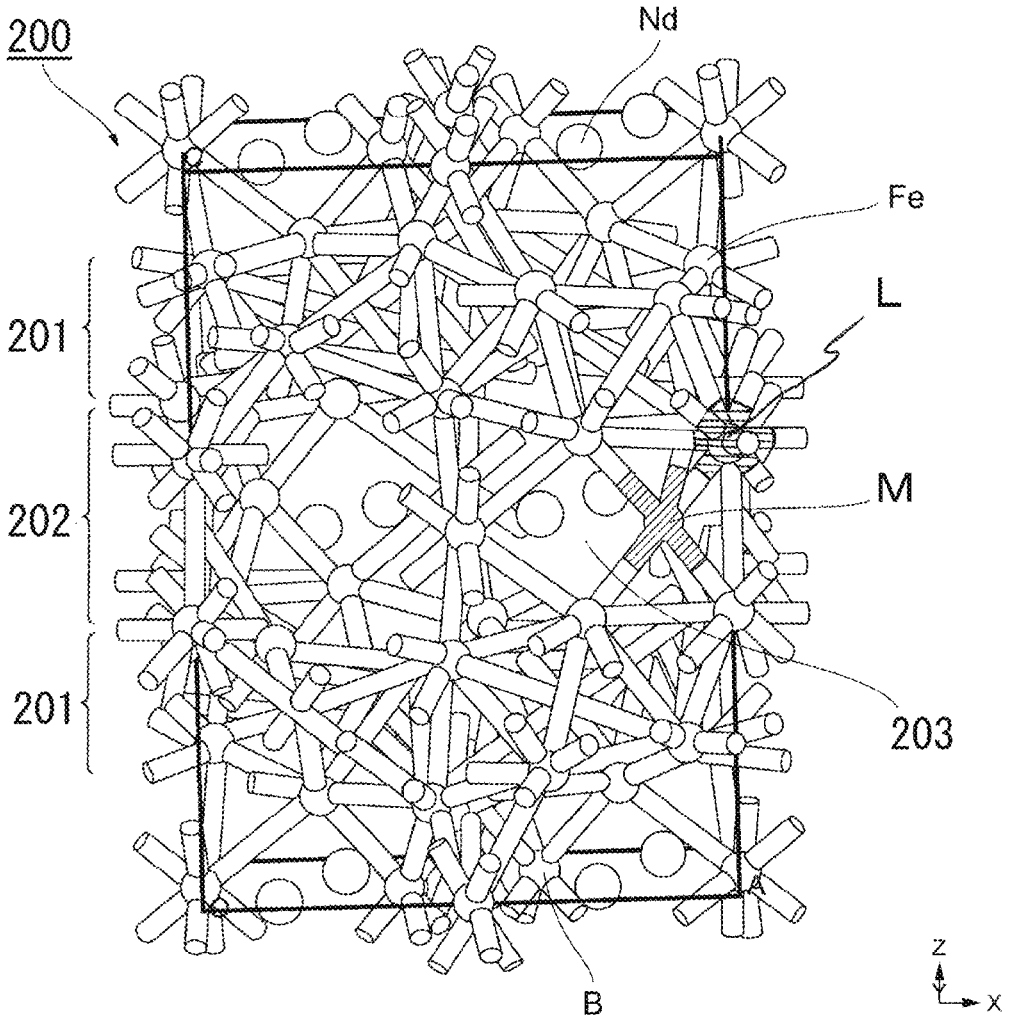
FIG. 2 is a schematic view illustrating an example of a crystal structure of the present disclosure.

The compound constituting the main phase of the present disclosure contains any one or more types of elements selected from a group consisting of cobalt, beryllium, lithium, aluminum, and silicon and contains neodymium, iron, and boron. FIG. 1 and FIG. 2 show schematic views of examples of the crystal structures represented by the aforementioned expression (1) and expression (2), respectively.

FIG. 1 is a schematic view illustrating an example of the crystal structure of the present disclosure as represented by the expression (1). Referring to FIG. 1, the relevant compound has a basic skeleton composed of Fe and an Fe layer 101 and an Nd—B-M layer 102 exist alternately in the z-axis direction. The Nd—B-M layer 102 contains neodymium (Nd), boron (B), and element M and interstices 103 exist.

Regarding the element M, an element whose wave function fits in the relevant interstice 103 and which has a smaller atomic radius than that of boron, for example, any one cobalt, beryllium, lithium, aluminum, and silicon, is selected as appropriate. The compound for which such an element is used as a raw material constituent has a structure in which part of the B atoms is substituted with M atoms as compared to the structure of the conventionally known $Nd_2Fe_{14}B$ crystal, and has a tetragonal crystal structure with P4/mnm and lattice constants a=8.81 Å and c=12.21 Å.

As the element M of the expression (1), any one or more elements of cobalt, beryllium, lithium, aluminum, and silicon should preferably be selected. Cobalt is more preferable.

A content ratio of constituent elements of the above-described compound on a basis of the number of atoms is neodymium (Nd):iron (Fe):boron (B):M=2:14:(1−x):x, and x should preferably satisfy $0.01 \leq x \leq 0.25$ and should more preferably satisfy $0.03 \leq x \leq 0.25$. Part of B can be naturally substituted with another element M by sintering an alloy of the above-described content ratio.

As the element M is contained in the relevant compound particulates by 1 to 25 at % relative to the number of neodymium atoms, electrons donated from the Nd atoms to the B atoms in the compound are reduced, thereby making it possible to enhance the magnetic moment of the Nd atoms. As a result, the present disclosure exhibits a high magnetic moment and a good magnetic property.

FIG. 2 is a schematic view illustrating an example of the crystal structure of the present disclosure as represented by the expression (2). Referring to FIG. 2, the relevant compound has a basic skeleton composed of the Fe atoms and L atoms and an Fe-L layer 201 and an Nd—B-M layer 202 exist alternately in the z-axis direction. The Nd—B-M layer 202 contains neodymium (Nd), boron (B), and M atoms and interstices 203 exist.

Since the iron of the above-described basic skeleton has a high density, any element whose atomic radius is extremely larger than that of the iron atoms can hardly be selected as the element L. However, it is presumed that if the wave functions of atoms in the elements are appropriately superimposed on each other, the relevant atoms in the elements may be easily substituted for the iron atoms in the crystal. An explanation about the element M as illustrated in FIG. 2 is the same as the aforementioned explanation about the element M as illustrated in FIG. 1.

Any one or more of cobalt, beryllium, lithium, aluminum, and silicon should preferably be selected as the element M and the element L in the expression (2) which satisfies the above-described conditions. Cobalt is more preferable. Normally the same element is selected as M and L, but different elements may be selected as M and L. From the viewpoint of simplifying a manufacturing process, the same element should preferably be selected. From the viewpoint of enhancing the magnetic moment of the Fe atoms, at least the cobalt should preferably be selected as M.

A content ratio of constituent elements of the compound represented by the expression (2) on a basis of the number of atoms is neodymium (Nd):iron (Fe):L:boron (B):M=2:(14−y):y:(1−x):x. It is preferable that y should satisfy $0<y<2$, and more preferably $0.1<y<1.2$. It is preferable that x should satisfy $0.01 \leq x \leq 0.25$, and more preferably $0.02 \leq x \leq 0.25$. Furthermore, x and y should preferably satisfy $0.01<(x+y)<2.25$, and more preferably $0.12<(x+y)<1.45$.

As the compound represented by the expression (2) contains the element M by 1 to 25 at % relative to the number of Nd atoms in the relevant compound particulates, electrons donated from the Nd atoms to the B atoms in the compound are reduced, thereby making it possible to enhance the magnetic moment of the Nd atoms. As a result, the present disclosure exhibits a high magnetic moment and a good magnetic property.

The rare earth permanent magnet of the present disclosure has the Nd—Fe—B layer and the Fe layer periodically and part of boron contained in the Nd—Fe—B layer is substituted with any one or more types of elements selected from a group consisting of cobalt, beryllium, lithium, aluminum, and silicon.

Figure 16:
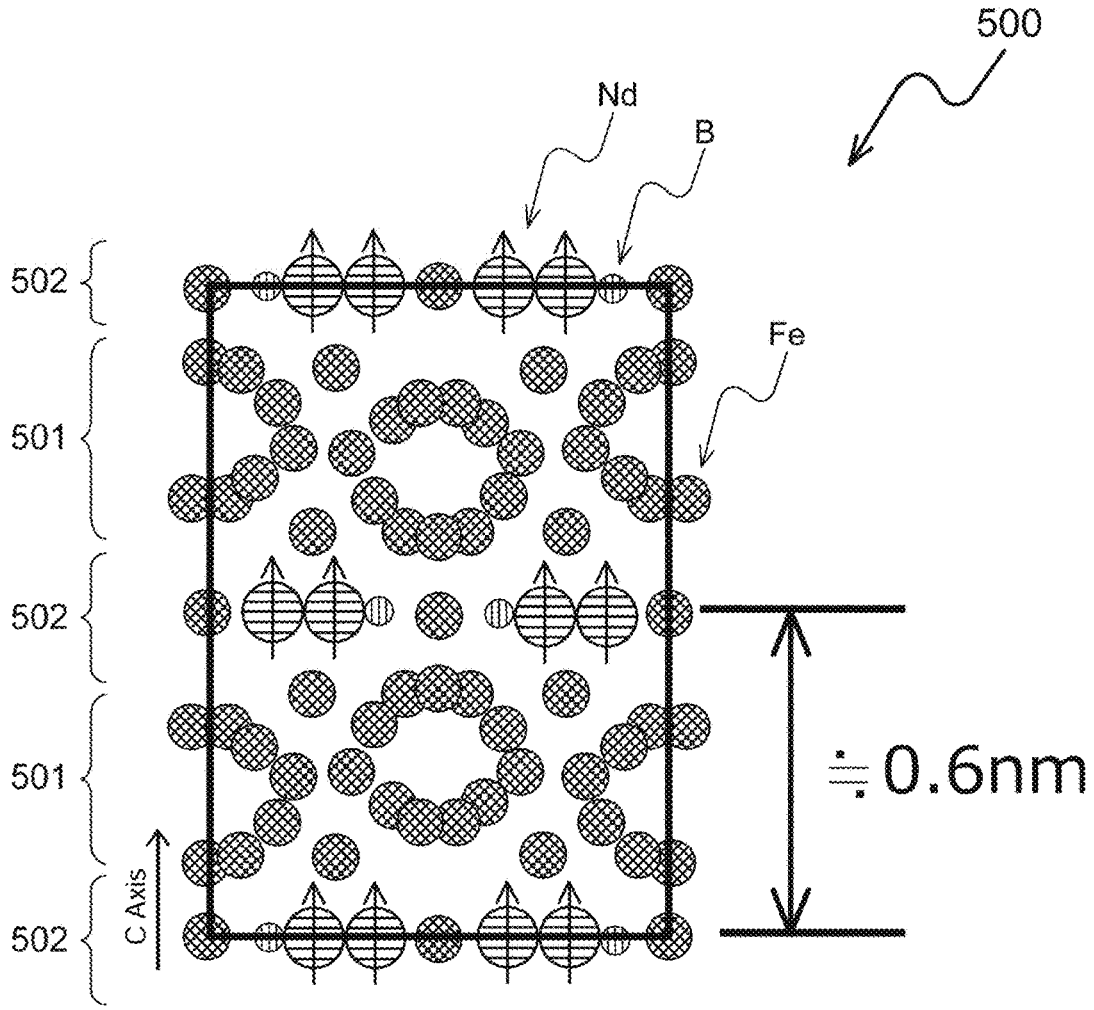
FIG. 16 is a model diagram of the crystal structure of a main phase of the rare earth permanent magnet according to the present disclosure.

FIG. 16 is a model diagram illustrating the crystal structure of the main phase of the rare earth permanent magnet of the present disclosure which was obtained by analyzing an example of the present disclosure by a Three Dimensional Atom Probe (3DAP). The details of the example and its analysis method will be explained later. In FIG. 16, 500 represents a unit lattice of the main phase, 501 represents an Fe layer, and 502 represents an Nd—Fe—B layer. FIG. 16 shows that the Fe layer 501 and the Nd—Fe—B layer 502 exist alternately. The analysis result by the Rietveld method described later indicates that cobalt atoms exist at sites where the B atoms of the Nd—Fe—B layer in the conventional $Nd_2Fe_{14}B$ crystal exist.

According to the present disclosure, the Nd—Fe—B layer should preferably contain terbium. Furthermore, the Nd—Fe—B layer should preferably contain any one or more types of elements of praseodymium and dysprosium. An aspect where terbium, praseodymium, and dysprosium exist at whatever sites in the Nd—Fe—B layer also falls under the crystal structure of the main phase according to the present disclosure. Specifically speaking, each one of terbium, praseodymium, and dysprosium may be substituted with Nd or Fe and may enter the interstices.

If the present disclosure explained above is summarized from the viewpoint of the constituents of the main phase according to the present disclosure described above, we can say, in other words, that the main phase contains neodymium, iron, and boron and further contains any one or more types of elements selected from a group consisting of cobalt, beryllium, lithium, aluminum, and silicon.

The rare earth permanent magnet of the present disclosure contains iron as its main constituent more than any other constituents and the content of iron is sometimes expressed as the remainder relative to the other constituents. Regarding the other constituents relative to the total weight of the rare earth permanent magnet, the content of neodymium should preferably be 20 to 35 wt % and more preferably 22 to 33 wt %. The content of boron should preferably be 0.80 to 0.99 wt % and more preferably 0.82 to 0.98 wt %. The total content of any one or more types of elements selected from a group consisting of cobalt, beryllium, lithium, aluminum, and silicon is 0.8 to 1.0 wt %. As a result, the present disclosure can obtain a good residual magnetic flux density Br.

The present disclosure should preferably contain terbium in addition to the above-described constituents. The present disclosure can enhance the coercive force $H_{cj}$ of the rare earth permanent magnet by containing terbium in addition to any one or more types of elements selected from a group consisting of cobalt, beryllium, lithium, aluminum, and silicon.

The compound containing terbium can be represented by the following expression (3) or expression (4).

[Chem. 5]

$$Nd_{(2-z)}Tb_zFe_{14}B_{(1-x)}M_x \quad (3)$$

In the above-described expression (3), M represents an element selected from any one of cobalt, beryllium, lithium, aluminum, and silicon, x satisfies $0.01 \leq x \leq 0.25$, and z satisfies $1<z<1.8$. In the expression (3), in a case of $x<0.01$, the magnetic moment of the neodymium atoms reduces. In a case of $x>0.25$, the crystal structure becomes unstable. In a case of $z \leq 1$, this causes a reduction of holding force. In a case of $z \geq 0.8$, the residual magnetic flux density reduces.

[Chem. 6]

$$Nd_{(2-z)}Tb_zFe_{(14-y)}L_yB_{(1-x)}M_x \quad (4)$$

In the above-described expression (4), each of M and L is an element selected from any one of cobalt, beryllium, lithium, aluminum, and silicon, y is $0<y<2$, x is $0.01 \leq x \leq 0.25$, and x and y satisfy $0.01<(x+y)<2.25$. Furthermore, z is $1<z<1.8$. When x, y, z, and x+y are out of the above-described ranges, the residual magnetic flux density and the coercive force decrease.

The rare earth permanent magnet of the present disclosure containing the terbium contains the iron as its main constituent more than any other constituents and the content of iron is sometimes expressed as the remainder relative to the other constituents. Regarding the other constituents relative to the total weight of the rare earth permanent magnet, the content of neodymium should preferably be 20 to 35 wt % and more preferably 22 to 33 wt %. The content of boron should preferably be 0.80 to 0.99 wt % and more preferably 0.82 to 0.98 wt %. The total content of any one or more types of elements selected from a group consisting of cobalt, beryllium, lithium, aluminum, and silicon is 0.8 to 1.0 wt %. The content of terbium is 2.0 to 10.0 wt % and more preferably 2.5 to 4.5 wt %. As a result, the present disclosure can obtain a good residual magnetic flux density Br.

When the present disclosure contains neodymium, iron, and boron and further contains any one or more types of elements selected from a group consisting of cobalt, beryllium, lithium, aluminum, and silicon and contains terbium, it has a magnetic property that that satisfies any one or more conditions of a group consisting of mc1 and mc2 at a temperature condition of 20° C.

Mc1 represents the magnetic property indicating that the residual magnetic flux density Br is 12.90 kG or more. The residual magnetic flux density Br should more preferably be 13.00 kG or more as mc1. Mc2 represents the magnetic property indicating that the coercive force $H_{cj}$ is 27.90 kOe or more. The coercive force $H_{cj}$ should more preferably be 28.20 kOe or more as mc2. Incidentally, any magnetic property of the present disclosure can be measured by using a pulse-excitation-type magnetic property measurement apparatus with a specimen temperature variator which is conventionally known.

The present disclosure containing the above-mentioned elements has a magnetic property that satisfies any one or more conditions of a group consisting of mc3 and mc4 at a temperature condition of 100° C. Mc3 represents the magnetic property indicating that the residual magnetic flux density Br is 11.80 kG or more. The residual magnetic flux density Br should more preferably be 11.85 kG or more as mc3. Mc4 represents the magnetic property indicating that the coercive force $H_{cj}$ is 17.40 kOe or more. The coercive force $H_{cj}$ should more preferably be 18.20 kOe or more as mc4.

The present disclosure containing the above-mentioned elements has a magnetic property that satisfies any one or more conditions of a group consisting of mc5 and mc6 at a temperature condition of 160° C. Mc5 represents the magnetic property indicating that the residual magnetic flux density Br is 10.80 kG or more. The residual magnetic flux density Br should more preferably be 10.95 kG or more as mc5. Mc6 represents the magnetic property indicating that the coercive force $H_{cj}$ is 10.50 kOe or more. The coercive force $H_{cj}$ should more preferably be 11.00 kOe or more as mc6.

The present disclosure containing the above-mentioned elements has a magnetic property that satisfies any one or more conditions of a group consisting of mc7 and mc8 at a temperature condition of 200° C. Mc7 represents the magnetic property indicating that the residual magnetic flux density Br is 10.10 kG or more. The residual magnetic flux density Br should more preferably be 10.14 kG or more as mc7. Mc8 represents the magnetic property indicating that the coercive force $H_{cj}$ is 6.60 kOe or more. The coercive force $H_{cj}$ should more preferably be 6.90 kOe or more as mc8. According to the present disclosure, both the residual magnetic flux density Br and the coercive force $H_{cj}$ are good. The magnetic property of this present disclosure does not degrease even at a temperature condition higher than a room temperature.

The present disclosure may contain elements, such as praseodymium and dysprosium, that contributes to enhancement of the magnetic property. It is possible to manufacture the rare earth permanent magnet of the present disclosure, which exhibits the excellent magnetic property, at low cost by containing the praseodymium. The praseodymium contained in the present disclosure is mainly substituted with neodymium. It can also be dispersed in other areas within the crystal structure. The ratio of neodymium to praseodymium contained in the present disclosure on a basis of the number of atoms is 80:20 to 70:30.

From the viewpoint of the low cost, it is preferable that a proportion of the praseodymium should be larger and a proportion of the neodymium should be smaller; however, if the proportion of the neodymium becomes less than 70 on the basis of the above-described ratio of the number of atoms, the possibility of decrease of the residual magnetic flux density Br increases.

It is possible to enhance the magnetic property by containing dysprosium in the same manner as in the case of containing terbium. The dysprosium contained in the present disclosure is substituted for the iron. The dysprosium may be used solely as a substituent element of the iron or together with the terbium. Incidentally, besides being substituted for the iron, the elements such as terbium and praseodymium may be dispersed in other areas within the crystal structure.

The compound containing praseodymium and dysprosium can be represented by the following expression (5) or expression (6).

[Chem. 7]

$$Nd_{(2-z)}R1_{z1}R2_{z2}Fe_{14}B_{(1-z)}M_x \quad (5)$$

In the above-described expression (5), M represents an element selected from any one of cobalt, beryllium, lithium, aluminum, and silicon and x satisfies $0.01 \leq x \leq 0.25$. R1 represents praseodymium and R2 represents any one or more types of elements of terbium and dysprosium. Z, z1, and z2 satisfy $z=z1+z2$, $1<z<1.8$, and $0<z1<1.8$. When x, z, z1, and z2 are out of the above-described ranges, the residual magnetic flux density and the coercive force decrease.

[Chem. 8]

$$Nd_{(2-z)}R1_{z1}R2_{z2}Fe_{(14-y)}L_yB_{(1-x)} \quad (6)$$

In the above-described expression (6), M and L represent elements selected from any one of cobalt, beryllium, lithium, aluminum, and silicon, y is $0<y<2$, x is, $0.01\leq x\leq 0.25$, and x and y satisfy $0.01<(x+y)<2.25$. Z is $1<z<1.8$. R1 represents praseodymium and R2 represents any one or more types of elements of terbium and dysprosium. Z, z1, and z2 satisfy $z=z1+z2$, $1<z<1.8$, and $0<z1<1.8$. When x, y, x+y, z, z1, and z2 are out of the above-described ranges, the crystal structure cannot be maintained.

The main phase of the present disclosure has crystals containing neodymium, iron, and boron and containing any one or more types of elements selected from a group consisting of cobalt, beryllium, lithium, aluminum, and silicon. A sintered particle size $D_{50}$ of the crystals should preferably be 2 to 25 μm, more preferably 3 to 15 μm, and further more preferably 3 to 11 μm. Particularly when the crystals are refined to 3 to 6 μm, the obtained particles are preferable because they exhibit a good magnetic property even if the content of terbium is reduced.

Regarding the present disclosure, $D_{50}$ is a median diameter in cumulative distribution of an alloy particulate group on a volume basis. $D_{50}$ can be measured by known methods using a laser-diffraction-type particle-size distribution measuring apparatus. All numerical values indicating the "powder particle size," "sintered particle size," and "particle size" are $D_{50}$.

A raw material alloy used for the present disclosure forms crystals which become the main phase by a heat treatment step. The sintered particle size $D_{50}$ of such crystals is 110 to 300%, more specifically 110 to 180%, of the powder particle size $D_{50}$ of the raw material alloy. An example of a method for forming the crystals whose sintered particle size is within the above-described preferable range can include a method of molding the raw material alloy of an appropriate power particle size corresponding to the desired sintered particle size, magnetizing the raw material alloy, and applying a heat treatment to the raw material alloy. The powder particle size can be adjusted by known methods by using, for example, a ball mill or a jet mill.

According to the present disclosure, as the sintered density of the main phase becomes higher, the residual magnetic flux density becomes larger. Therefore, the sintered density should preferably be 6.0 g/cm$^3$ or more and a larger sintered density of 7.5 g/cm$^3$ or more is more preferable. However, the sintered density is determined based on the powder particle size of the raw material alloy, and a processing temperature, a sintering temperature, and an aging temperature in the heat treatment step. Therefore, according to the present disclosure, because of the raw material alloy which can be prepared and conditions of the heat treatment step, the sintered density is 6.0 to 8.0 g/cm$^3$, more preferably 7.0 to 7.9 g/cm$^3$, and further preferably 7.2 to 7.7 g/cm$^3$. When the sintered density is less than 7.0 g/cm$^3$, it is inappropriate for a magnet.

When the present disclosure contains neodymium, iron, and boron, further contains any one or more types of elements selected from a group consisting of cobalt, beryllium, lithium, aluminum, and silicon, contains terbium, and additionally contains any one or more types of praseodymium and dysprosium, it has a magnetic property that satisfies any one or more conditions of a group consisting of mc9 and mc10 at a temperature condition of 20° C.

Mc9 represents the magnetic property indicating that the residual magnetic flux density Br is 12.50 kG or more. The residual magnetic flux density Br should more preferably be 13.20 kG or more as mc9. Mc10 represents the magnetic property indicating that the coercive force $H_{cj}$ is 21.20 kOe or more. The coercive force $H_{cj}$ should more preferably be 29.50 kOe or more as mc10.

The present disclosure containing the above-described elements has a magnetic property that satisfies any one or more conditions of a group consisting of mc11 and mc12 at a temperature condition of 100° C. Mc11 represents the magnetic property indicating that the residual magnetic flux density Br is 11.60 kG or more. The residual magnetic flux density Br should more preferably be 12.30 kG or more as mc11. Mc12 represents the magnetic property indicating that the coercive force $H_{cj}$ is 11.80 kOe or more. The coercive force $H_{cj}$ should more preferably be 18.00 kOe or more as mc12.

The present disclosure containing the above-described elements has a magnetic property that satisfies any one or more conditions of a group consisting of mc13 and mc14 at a temperature condition of 160° C. Mc13 represents the magnetic property indicating that the residual magnetic flux density Br is 10.60 kG or more. The residual magnetic flux density Br should more preferably be 11.20 kG or more as mc13. Mc14 represents the magnetic property indicating that the coercive force $H_{cj}$ is 6.20 kOe or more. The coercive force $H_{cj}$ should more preferably be 10.00 kOe or more as mc14.

The present disclosure containing the above-described elements has a magnetic property that satisfies any one or more conditions of a group consisting of mc15 and mc16 at a temperature condition of 200° C. Mc15 represents the magnetic property indicating that the residual magnetic flux density Br is 9.60 kG or more. The residual magnetic flux density Br should more preferably be 10.30 kG or more as mc15. Mc16 represents the magnetic property indicating that the coercive force $H_{cj}$ is 3.80 kOe or more. The coercive force $H_{cj}$ should more preferably be 6.00 kOe or more as mc16.

According to the present disclosure containing the above-described elements, both the residual magnetic flux density Br and the coercive force $H_{cj}$ are good. The magnetic property of this disclosure does not decrease even at a temperature condition higher than a room temperature.

The rare earth permanent magnet of the present disclosure containing any one or more types of elements selected from a group consisting of praseodymium, terbium, dysprosium, and so on contains iron as its main constituent more than any other constituents and the content of iron is sometimes expressed as the remainder relative to the other constituents.

Regarding the other constituents relative to the total weight of the rare earth permanent magnet, the content of neodymium should preferably be 15 to 40 wt % and more preferably 20 to 35 wt %. The content of praseodymium is 5 to 20 wt % and more preferably 5 to 15 wt %. The content of boron should preferably be 0.80 to 0.99 wt % and more preferably 0.82 to 0.98 wt %. The total content of any one or more types of elements selected from a group consisting of cobalt, beryllium, lithium, aluminum, and silicon is 0.8 to 1.0 wt %. The content of any one or more types of elements of terbium and dysprosium is 2.0 to 10.0 wt % and more preferably 2.5 to 4.5 wt %. As a result, the present disclosure can obtain a good residual magnetic flux density Br.

In addition to the above-described specified main phase, the present disclosure should preferably include a grain boundary phase containing any one or more types of elements selected from a group consisting of aluminum, copper, niobium, zirconium, titanium, and gallium. Incidentally, the elements which form the grain boundary phase can be also dispersed in the main phase as appropriate. Since the amount of dispersion is very small, it is not reflected in the preferable content of each constituent in the above-described main phase.

Figure 6:
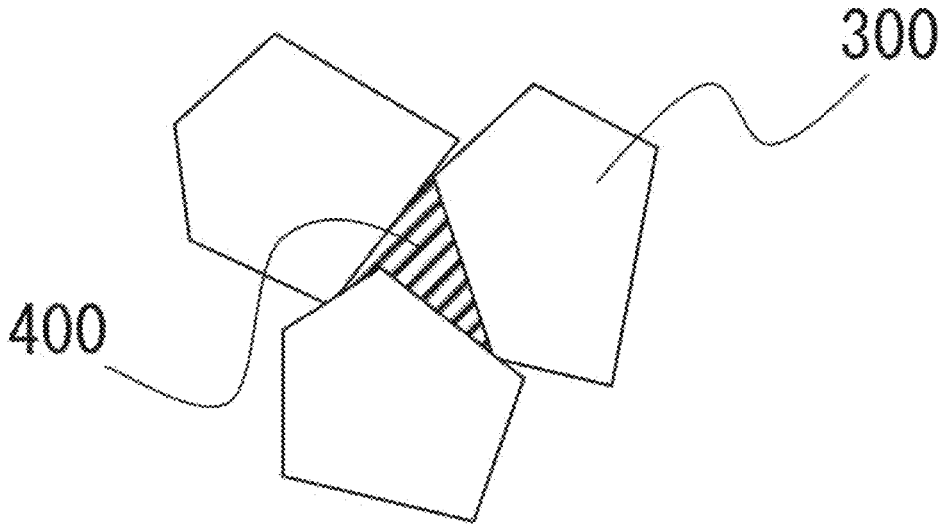
FIG. 6 is a schematic illustration of the microstructure of the present disclosure.

FIG. 6 is a schematic illustration showing an example of the microstructure of the present disclosure. Referring to FIG. 6, 300 represents the main phase and 400 represents the grain boundary phase. When a magnetic field is applied to the rare earth permanent magnet having the microstructure illustrated in FIG. 6, spin electrons of constituents of the grain boundary phase pin spin electrons of main constituents, thereby promoting spin reverse of the main phase constituents. Specifically speaking, the grain boundary phase disconnects a magnetic exchange coupling of the main phase. As a result, it is possible to enhance the coercive force $H_{cj}$.

Regarding a preferable content of the grain boundary phase constituents according to the present disclosure by percent by weight, the content of aluminum should be 0.1 to 0.4% and the content of copper should be 0.01 to 0.1%. More preferably, the content of aluminum should be 0.2 to 0.3% and the content of copper should be 0.02 to 0.09%. When zirconium is to be added, a preferable content of zirconium by percent by weight relative to the total weight of the rare earth permanent magnet should be 0.004 to 0.04% and more preferably 0.01 to 0.04%.

Regarding the content of each constituent for the present disclosure including the main phase and the grain boundary phase, the iron is contained as its main constituent more than any other constituents and the content of iron is sometimes expressed as the remainder relative to the other constituents. Regarding the content of other constituents relative to the total weight of the present disclosure by percent by weight, it is preferable that the content of neodymium should be 20 to 35%, the content of boron should be 0.80 to 0.99%, the total amount of any one or more types of elements selected from a group consisting of cobalt, beryllium, lithium, aluminum, and silicon should be 0.8 to 1.0%, and the content of terbium should be 2.0 to 10.0%; and in addition to the above constituents, the content of aluminum should be 0.1 to 0.4% and the consent of copper should be 0.01 to 0.1%.

As an example of a more preferable consent of the constituents other than the iron as described above by percent by weight, it is preferable that at least the content of neodymium should be 22 to 33%, the content of boron should be 0.82 to 0.98%, the total amount of any one or more types of elements selected from a group consisting of cobalt, beryllium, lithium, aluminum, and silicon should be 0.8 to 1.0%, and the content of terbium should be 2.6 to 5.4%; and in addition to the above constituents, the content of aluminum should be 0.2 to 0.3% and the content of copper should be 0.02 to 0.09%.

As another example of preferable content, it is preferable that the content of neodymium should be 15 to 40 wt %, the content of praseodymium should be 5 to 20 wt %, the content of terbium should be 2.0 to 10.0 wt %, the content of boron should be 0.80 to 0.99 wt %, and the total amount of any one or more types of elements selected from a group consisting of cobalt, beryllium, lithium, aluminum, and silicon should be 0.8 to 1.0 wt %; and in addition to the above constituents, the content of aluminum should be 0.1 to 0.4 wt % and the content of copper should be 0.01 to 0.1 wt %.

The present disclosure exhibits excellent heat resistance and has a high residual magnetic flux density Br, a high coercive force $H_{cj}$, and a large maximum energy product $BH_{max}$ even under the high-temperature condition. The magnetic property of the present disclosure regarding which the sintered particle size $D_{50}$ of the main phase is 3 to 11 μm is summarized below by each temperature condition. Incidentally, the magnetic property described below can be further enhanced by refining the crystal particle size of the main phase.

Regarding the magnetic property at the temperature condition 20° C., the residual magnetic flux density Br is distributed at 11.40 kG or more, preferably at 12.50 kG or more, and more preferably at 12.90 kG or more. The coercive force $H_{cj}$ is distributed at 21.20 kOe or more, and preferably at 27.90 kOe or more. The maximum energy product $BH_{max}$ is distributed at 31.00 MGOe or more, and more preferably at 40.10 MGOe or more.

Regarding the magnetic property at the temperature condition 100° C. according to the present disclosure, the residual magnetic flux density Br is distributed at least at approximately 10.00 to 12.00 kG. In addition, the residual magnetic flux density Br should preferably be distributed at 10.60 kG or more, and more preferably at 11.80 kG or more. The coercive force $H_{cj}$ is distributed at 11.80 kOe or more and at 17.00 to 19.00 kOe. The coercive force $H_{cj}$ should preferably be distributed at 17.40 kOe or more. The maximum energy product $BH_{max}$ is distributed at least at 33.00 to 35.00 MGOe. In addition, the maximum energy product $BH_{max}$ should preferably be distributed at 27.10 MGOe or more, more preferably at 36.80 MGOe or more.

Regarding the magnetic property at the temperature condition 160° C. according to the present disclosure, the residual magnetic flux density Br is distributed at least at approximately 9.000 to 11.00 kG. In addition, the residual magnetic flux density Br should preferably be distributed at 9.80 kG or more, and more preferably at 10.80 kG or more. The coercive force $H_{cj}$ is distributed at 6.200 kOe or more and at 11.00 to 12.00 kOe. The coercive force $H_{cj}$ should preferably be distributed at 10.50 kOe or more. The maximum energy product $BH_{max}$ is distributed at least at 27.00 to 29.00 MGOe. In addition, the maximum energy product $BH_{max}$ should preferably be distributed at 22.75 MGOe or more, more preferably at 27.80 MGOe or more.

Regarding the magnetic property at the temperature condition 200° C. according to the present disclosure, the residual magnetic flux density Br is distributed at 9.00 kG or more, preferably at 9.90 to 11.00 kG, more preferably at 9.60 kG or more, and more preferably at 10.10 kG or more. The coercive force $H_{cj}$ is distributed at 3.80 kOe or more and at approximately 6.50 to 7.00 kOe. The coercive force $H_{cj}$ should preferably be distributed at 6.60 kOe or more, and more preferably 15.90 kOe or more. The maximum energy product $BH_{max}$ is distributed at least at 22.90 to 24.00 MGOe. In addition, the maximum energy product $BH_{max}$ should preferably be distributed at 19.00 MGOe or more, more preferably at 23.70 MGOe or more.

In addition, the present disclosure has high mechanical strength. Tensile strength of the rare earth permanent magnet of the present disclosure is 80 MPa or more, preferably 100 MPa or more, and more preferably 150 MPa or more. In other words, the present disclosure has excellent machinability and can enhance mass productivity of products which use the present disclosure. It is also possible to enhance the products' life cycle. The tensile strength of the present disclosure can be measured by methods according to JIS Z2201 (tension test specimen processing method) and JIS Z2241 (tensile test measurement method).

[Rare Earth Permanent Magnet Manufacturing Method]

The method for manufacturing the rare earth permanent magnet according to the present disclosure is not particularly limited as long as the function effects of the present disclosure can be obtained. An example of a preferable manufacturing method according to the present disclosure can be a manufacturing method including a microparticulation step, a magnetization step, and a heat treatment step. The rare earth permanent magnet of the present disclosure can be manufactured by cooling a product, which is obtained as a result of each of the above-described steps, down to a room temperatures in a cooling step.

[Microparticulation Step]

In the microparticulation step, specified materials (M, L) such as Co and Fe, Nd, and B are dissolved at the stoichiometric ratio explained above, thereby obtaining a raw material alloy. When praseodymium, terbium, and aluminum as well as copper, niobium, zirconium, titanium, gallium, and so on are contained, starting materials containing these elements are added as raw materials when manufacturing the above-described raw material alloy.

The stoichiometric ratio of the composition of the raw material alloy is almost the same as the composition of the compound which becomes the main phase of the present disclosure that is a final product. Therefore, it is only necessary to combine the raw materials according to the composition of the desired compound. The obtained raw material alloy is coarsely ground by using, for example, a ball mill or a jet mill. It is also preferable that particulates of the raw material alloy which are then obtained by coarse grinding should be refined by using, for example, the ball mill or the jet mill.

The coarsely-ground raw material alloy particles are dispersed in an organic solvent and a reducing agent is added to the obtained product. As a result of reduction processing, the raw material alloy particles are atomized and its particle size becomes a powder particle size of 1.8 to 22.7 μm. When the reduction processing is executed on the microparticulated raw material alloy particles, the powder particle size becomes much smaller to 2.7 to 13.6 μm, more specifically 2.7 to 10.0 μm.

[Magnetization Step]

In the magnetization step, the obtained raw material alloy particulates are compression-molded in an oriented magnetic field. Furthermore, in the heat treatment step, the obtained molded body is heated under vacuum and then the obtained sinter is rapidly cooled to a room temperature. Subsequently, the heat treatment step is conducted under an inert gas atmosphere and then the sinter is cooled down to a room temperature.

[Heat Treatment Step]

In the heat treatment step, the main phase and the grain boundary phase are formed by conducting specified temperature management and time management. The heat treatment conditions are determined based on melting points of the constituents. Specifically speaking, all the constituents are dissolved by increasing the processing temperature to a main-phase-forming temperature and maintaining that temperature. Then, in the process of decreasing the temperature from the main-phase-forming temperature to a grain-boundary-phase-forming temperature, the main phase constituents enter a solid phase and the grain boundary phase constituents start depositing on a solid phase surface. The grain boundary phase can be formed by maintaining the grain-boundary-phase-forming temperature.

As an example of the heat treatment conditions to form the main phase, the temperature should preferably be retained at 1000 to 1200° C. for 3 to 5 hours and then further retained at 880 to 920° C. for 4 to 5 hours. More preferably, the temperature should be retained at 1010 to 1190° C. for 3 to 5 hours and then further retained at 890 to 910° C. for 3 to 5 hours.

As an example of the heat treatment conditions to form the grain boundary phase, the temperature should preferably be retained at 480 to 520° C. for 3 to 5 hours and then further retained at 490 to 510° C. for 3 to 5 hours.

The present disclosure can be manufactured by executing at least each of the above-described steps. The present disclosure can manufacture the rare earth permanent magnet by applying the conventionally-known method for manufacturing the rare earth permanent magnet only by using the alloy, in which Nd, Pr, Tb, etc. and Fe, B, Co, etc. of the specified content described earlier are dissolved, as raw materials. Furthermore, when manufacturing the rare earth permanent magnet which includes the specified main phase and grain boundary phase, the rare earth permanent magnet of the present disclosure can be manufactured easily by applying the above-explained heat treatment step.

By the method for manufacturing the rare earth permanent magnet of the present disclosure, the powder particle size of the raw material compound should preferably be 1.8 to 22.7 μm. By using the powder particle size of more preferably 2.7 to 13.6 μm, and further preferably 2.7 to 10.0 μm and retaining the raw material compound at the main-phase-forming temperature, the rare earth permanent magnet with an excellent magnetic property can be manufactured even if the content of terbium is suppressed. As a result of the heat treatment step, the sintered particle size of the raw material compound becomes 110 to 300%, or preferably 110 to 180%, of the powder particle size.

When the raw material alloy particulates of the powder particle size within the above-described preferable range are sintered, the sintered particle size becomes 2 to 25 μm, preferably 3 to 15 μm, more preferably 3 to 11 μm, and particularly preferably 3 to 6 μm. Particularly when crystals are refined to achieve the particle size of 3 to 11 μm, the rare earth permanent magnet of the present disclosure having the main phase of the crystals of the above-described sintered particle size decreases the content of terbium by 20 to 30% and has an equivalent magnetic property. In order to make the raw material alloy particles of the above-described powder particle size, such power particle size can be obtained by grinding the crystals by using the jet mill or the ball mill.

A sintered density of the alloy compound which includes the crystals of the above-described preferable sintered particle size as the main phase becomes 6 to 8 g/cm$^3$, and more preferably 7.2 to 7.9 g/cm$^3$. A method for measuring the sintered density will be described below. The weight used for measurement of the sintered density was measured by measuring samples with an electronic scale. Furthermore, the volume was found by the Archimedean Method or by measuring the dimensions of the samples with a ruler.

EXAMPLES

The present disclosure will be further explained by referring to examples below. However, the present disclosure is not limited to the examples described below.

Examples 1 to 5

Cobalt (Co), Nd, Fe, and B were arc-melted, thereby obtained a raw material alloy. The obtained 5 kg alloy was coarsely ground with the ball mill, thereby obtaining alloy particles with an average particle diameter of 16 μm. Subsequently, the alloy particles was dispersed in a solvent. An additive was introduced into the dispersed solution, which was then stirred to cause a reduction reaction to refine the alloy particles. An average particle diameter of the obtained fine alloy powder was 16 to 25 μm. The same process can be conducted on any one type of metal from among beryllium (Be), lithium (Li), aluminum (Al), and silicon (Si) besides cobalt (Co).

Respective samples of the above-described fine alloy powder were used as raw material compounds 1 to 5 and their magnetic moments were calculated by referring to atomic locations obtained by a neutron diffraction method (O. Isnard et. al J. Appl. Phys. 78 (1995) 1892-1898). Table 2 shows the magnetic moments of the raw material compounds 1 to 5. Furthermore, as a result of analysis by calculation, each crystal structure of the raw material compounds 1 to 5 was tetragonal and $P4_3/mnm$ and lattice constants were a=8.81 Å and c=12.21 Å according to X-ray diffraction simulation.

type particle-size distribution measuring apparatus SALD-2300 made by SHIMADZU CORPORATION.

The molding cavity was filled with 500 g of the obtained alloy particulates 500 g and a 19 kOe magnetic field with a molding pressure of 2 t/cm$^2$ was applied to the alloy particulates of each example to conduct compression molding and magnetization. A heat treatment was applied to each obtained molded body under a $2\times10^1$ Torr Ar gas atmosphere under the conditions indicated in FIG. 8 to FIG. 10 (Example 6), FIG. 28 and FIG. 29 (Example 7), FIG. 32 and FIG. 33 (Example 8), FIG. 36 and FIG. 37 (Example 9), FIG. 40 and FIG. 41 (Example 10), and FIG. 44 to FIG. 47 (Example 11 to Example 14). After the heat treatment terminated, the temperature was cooled down to a room temperature, and then the obtained product was removed from the cavity, thereby obtaining rare earth permanent magnets of Example 6 to Example 14. One or more samples were prepared in each of Example 6 to Example 14.

TABLE 2

| Atomic Location When Lattice Constant Is Normalized Fractional atomic positions | | | | Magnetic Moment (Bohr Magnetron, μs) | | | | | |
|---|---|---|---|---|---|---|---|---|---|
| | | | | Raw Material Compound 1 | Raw Material Compound 2 | Raw Material Compound 3 | Raw Material Compound 4 | Raw Material Compound 5 | Raw Material Compound 6 |
| Site | x | y | z | M = Co | M = Be | M = Li | M = Al | M = Si | $Nd_2Fe_{14}B$ |
| Nd (1) | 0.1415 | 0.1415 | 0 | 3.82 | 3.82 | 3.82 | 3.80 | 3.8 | 2.62 |
| Nd (2) | −0.2687 | 0.2687 | 0 | 3.8 | 3.82 | 3.82 | 3.78 | 3.78 | 2.58 |
| Fe (1) | 0 | 0.5 | 0 | 2.76 | 2.74 | 2.72 | 2.60 | 2.62 | 2.74 |
| Fe (2) | 0.7235 | 0.0671 | 0.3731 | 2.46 | 2.46 | 2.54 | 2.32 | 2.26 | 2.56 |
| Fe (3) | 0.4621 | 0.1413 | 0.3237 | 2.6 | 2.46 | 2.60 | 2.6 | 2.60 | 2.64 |
| Fe (4) | 0.1826 | 0.1826 | 0.2535 | 2.78 | 2.78 | 2.76 | 2.8 | 2.80 | 2.86 |
| Fe (5) | 0.4021 | 0.4021 | 0.2951 | 2.6 | 2.58 | 2.58 | 2.6 | 2.60 | 2.66 |
| Fe (6) | 0 | 0 | 0.3856 | 2.22 | 2.46 | 2.44 | 1.92 | 1.82 | 2.38 |
| M | 0.3757 | 0.3757 | 0 | −0.18 | −0.06 | 0.04 | 0.04 | 0 | −0.16 |

A molding cavity was filled with 500 g of the raw material compound (the raw material compound 1) which used cobalt (Co), a 19 kOe magnetic field with a molding pressure of 2 t/cm$^2$ was applied to conduct compression molding and magnetization. The obtained molded body was heated at a treatment temperature of 1090° C. for one hour under a $2\times10^1$ Torr Ar gas atmosphere. After the heat treatment terminated, the temperature was cooled down to a room temperature, and then the obtained product was removed from the cavity, thereby obtaining a rare earth permanent magnet of Example 1. Rare earth permanent magnets of Examples 2 to 5 for which any one type of metals from among beryllium (Be), lithium (Li), aluminum (Al), and silicon (Si) was used can be obtained in the same manner.

Example 6 to Example 14

The raw material alloy containing the respective elements with the content indicated in FIG. 7 was ground, thereby obtaining alloy particles. Subsequently, the alloy particles were dispersed in a solvent. An additive was introduced to the dispersed solution, which was then stirred to cause a reduction reaction, thereby refining the alloy particles. An average particle diameter of the alloy particulates of Example 6 and Example 9 was 16 to 25 μm. The average particle diameter (powder particle size) of the alloy particulates of Example 7, Example 8, and Example 10 to Example 12 was 3 to 11 μm. The average particle diameter was measured with an apparatus equivalent to a laser-diffraction- In the following explanation, each example number means that the relevant rare earth permanent magnet has a composition of the example number indicated in FIG. 7. The composition indicated in FIG. 7 is a ratio of charged amounts of raw materials for each rare earth permanent magnet. A branch number of each example means a sample number of the relevant example. For example, each of Example 6-1, Example 6-2, and Example 6-3 is a sample of the rare earth permanent magnet having the composition of Example 6.

In Example 7, the content in the rare earth permanent magnet was also measured in addition to the charged amounts indicated in FIG. 7. An apparatus equivalent to an ICP emission spectrometer (ICP Emission Spectroscopy) ICPS-8100 by SHIMADZU CORPORATION was used as a measurement apparatus. Table 3 shows measurement results.

TABLE 3

| | Element | | | | | |
|---|---|---|---|---|---|---|
| | Nd | B | Al | Cu | Co | Fe |
| Content in Raw Material Alloy (wt %) | 29.788 | 0.972 | 0.251 | 0.065 | 0.905 | Bal. |

The residual magnetic flux density Br, the coercive force $H_{cJ}$, and the maximum energy product $BH_{max}$ of Example 6 to Example 14 were measured. Furthermore, the tensile strength was measured at a room temperature (25° C.). The measurement results of Example 6 to Example 14 are shown in FIG. 8 to FIG. 10 (Example 6), FIG. 28 and FIG. 29 (Example 7), FIG. 32 and FIG. 33 (Example 8), FIG. 36 and FIG. 37 (Example 9), FIG. 40 and FIG. 41 (Example 10), and FIG. 44 to FIG. 47 (Example 11 to Example 14).

In Example 6 to Example 10, the crystal structure of the main phase was analyzed. A magnetic property measurement method, a tensile strength measurement method, and a crystal structure analysis method are as described below.

[Method for Measuring Residual Magnetic Flux Density Br, Coercive Force $H_{cj}$, and Maximum Energy Product $BH_{max}$]

Measurement Apparatus: apparatus equivalent to TPM-2-08S pulse-excitation-type magnetic property measurement apparatus with specimen temperature variator made by TOEI INDUSTRY, CO., LTD.

[Tensile Strength Test]

The tensile strength test was conducted by a method according to JIS Z2201 (tension test specimen processing method) and JIS Z2241 (tensile test measurement method).

[Crystal Structure Analysis by 3DAP]

Figure 11:
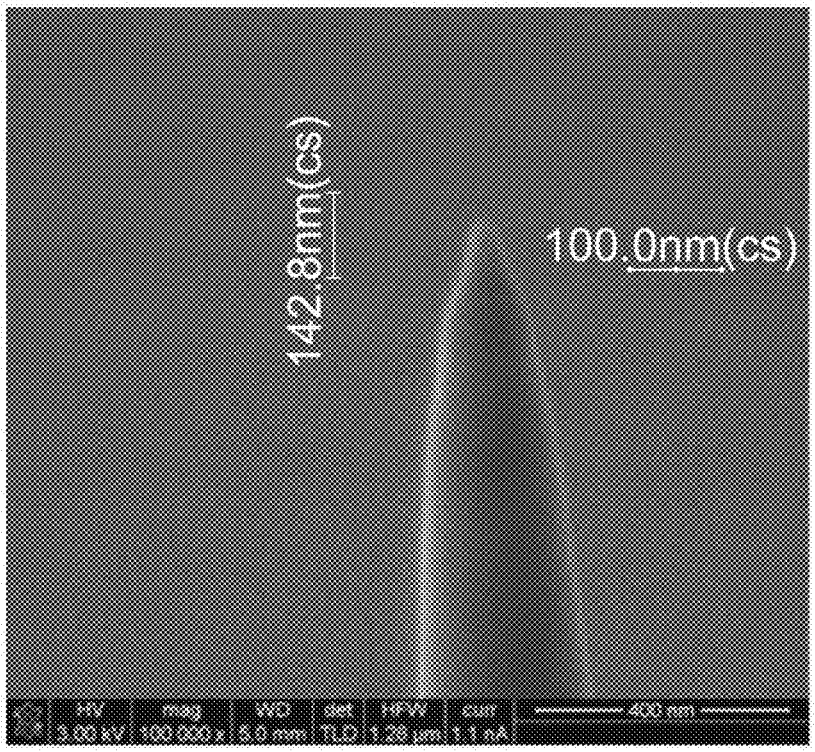
FIG. 11 is an SEM photograph of a needle-like substance obtained by processing an example of the present disclosure.

A needle-like substance to be used for 3DAP analysis as a sample was processed by a method described below in order to observe the crystal structure of the main phase of the rare earth permanent magnet of the example. Specifically speaking, after the example sample was firstly set to a focused ion beam machining observation device (Focused Ion Beam [FIB]), the grooves were processed to observe a surface including an easy magnetization direction. The surface of the sample including the easily-magnetizing direction, which had appeared by processing the grooves, was irradiated with electron beams. The main phase (inside the grains) was identified by observing, with SEM, a reflection electron beams emitted from the specimen as a result of the irradiation. The sample was processed to form a needle-like shape in order to analyze the identified main phase by means of the 3DAP. FIG. 11 is a SEM image of the needle-like substance of Example 6-10.

Conditions for the crystal structure analysis by means of the 3DAP are as follows.

Device Name: LEAP3000XSi (by AMETEK)

Measurement Condition: laser pulse mode (laser wavelength=532 nm)

Laser power=0.5 nJ, specimen temperature=50K

Figure 12:
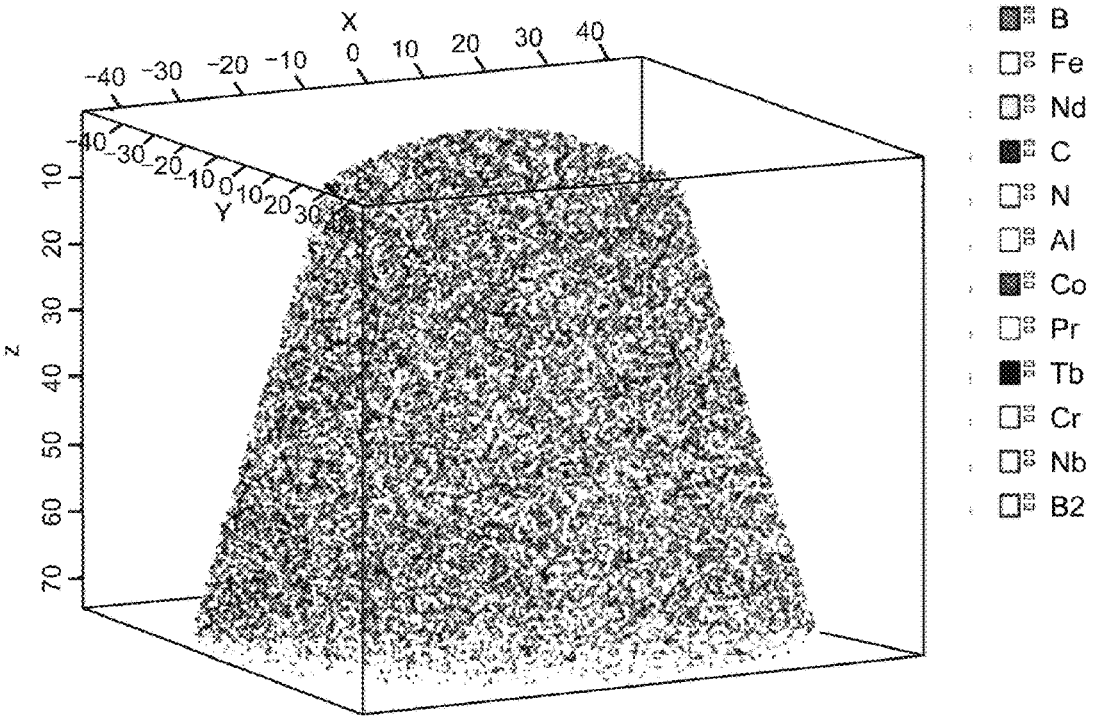
FIG. 12 is a 3D atomic image of the needle-like substance obtained by processing an example of the present disclosure.
Figure 13:
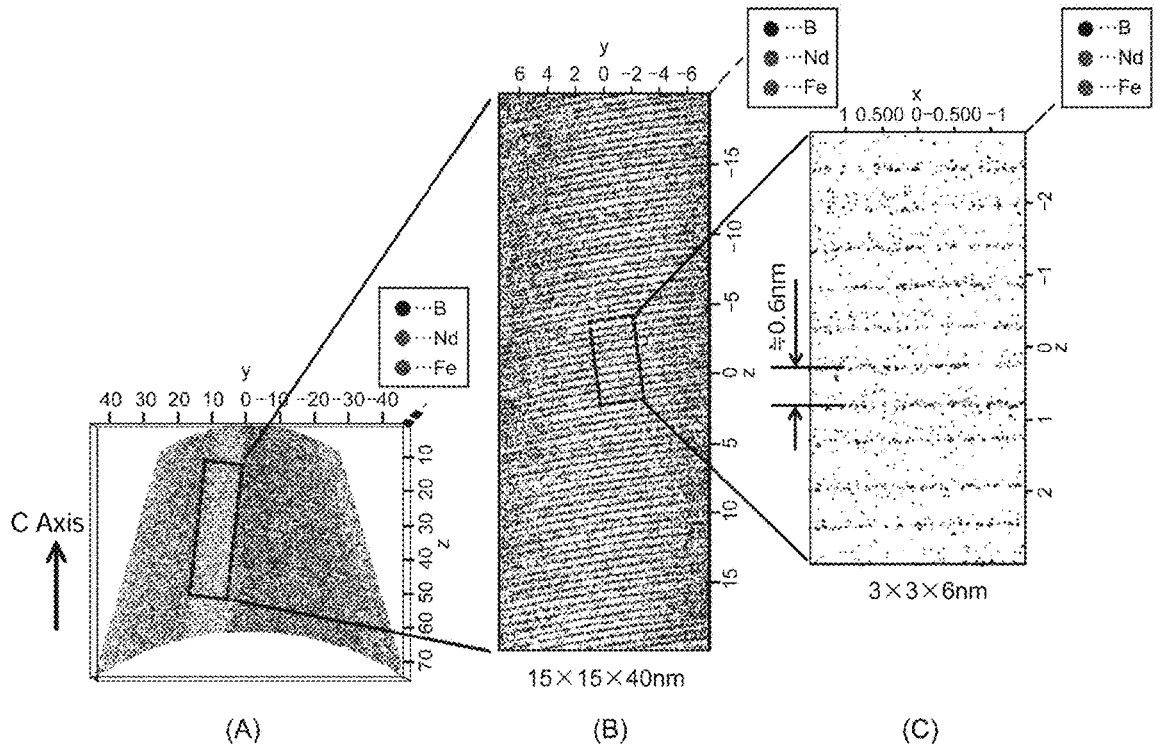
FIG. 13 is an analysis result of the crystal structure by 3DAP according to an example of the present disclosure.

FIG. 12 is a 3D atomic image of the needle-like substance of Example 6-10. FIG. 13(A) is a 3D slice image of the needle-like substance observed by the 3DAP. FIG. 13(B) is an enlarged view of part of an area shown in FIG. 13(A) and FIG. 13(C) is an enlarged view of part of an area shown in FIG. 13(B). Table 4 shows the detected quantity of each element detected in FIG. 13(B). Referring to FIG. 13(C), lattice planes of Nd [100] were detected. The interplanar spacings was 0.59 to 0.62 nm. FIG. 13(B) and FIG. 13(C) shows that the crystal structure of the main phase according to the present disclosure is a structure which has an Nd—Fe—B layer and an Fe layer periodically. In an example of the crystal structure of Example 6-10, the Nd—Fe—B layer and the Fe layer exist alternately.

TABLE 4

| Element | Detected Quantity (%) |
|---|---|
| Fe | 83.16 |
| Nd | 10.41 |
| B | 3.22 |

TABLE 4-continued

| Element | Detected Quantity (%) |
|---|---|
| Tb | 1.67 |
| Co | 0.99 |
| Al | 0.31 |
| N | 0.12 |
| Nb | 0.04 |
| Pr | 0.03 |
| C | 0.02 |
| Cr | 0.01 |

Figure 14:
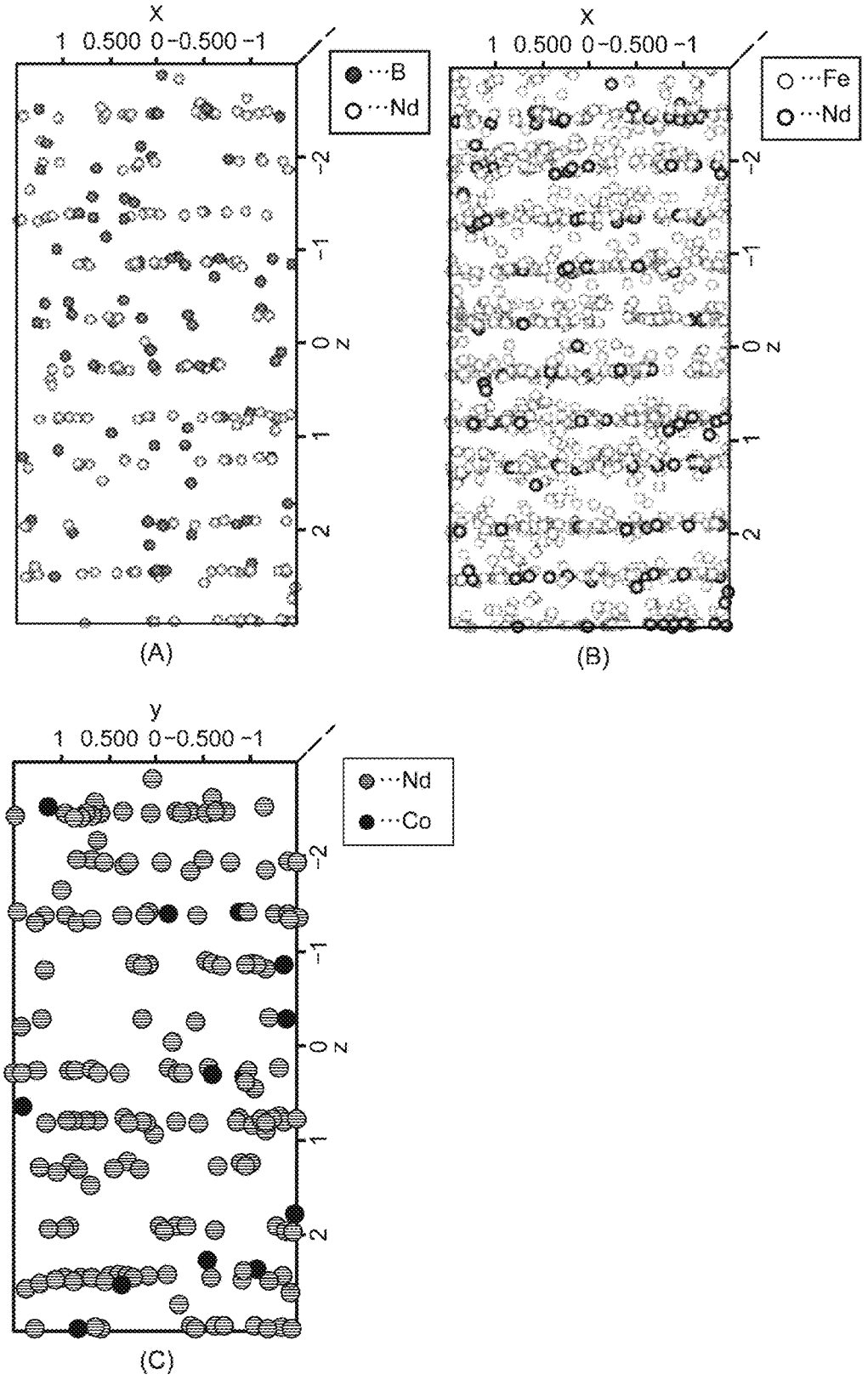
FIG. 14 is an analysis result of the crystal structure by the 3DAP according to an example of the present disclosure.
Figure 15:
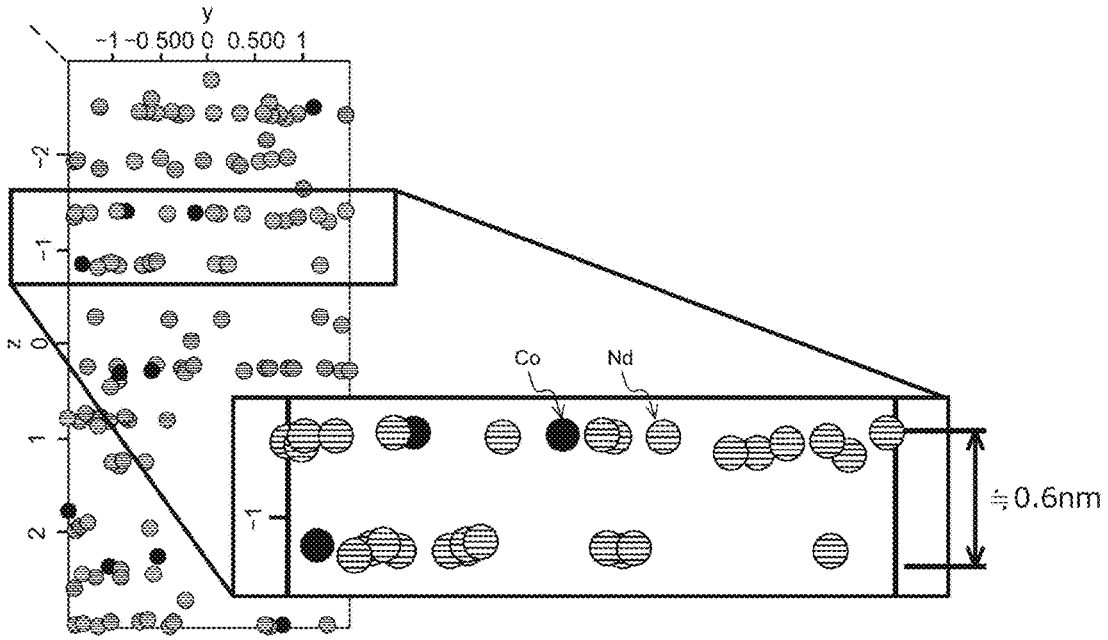
FIG. 15 is an analysis result of the crystal structure by the 3DAP according to an example of the present disclosure.
Figure 17:
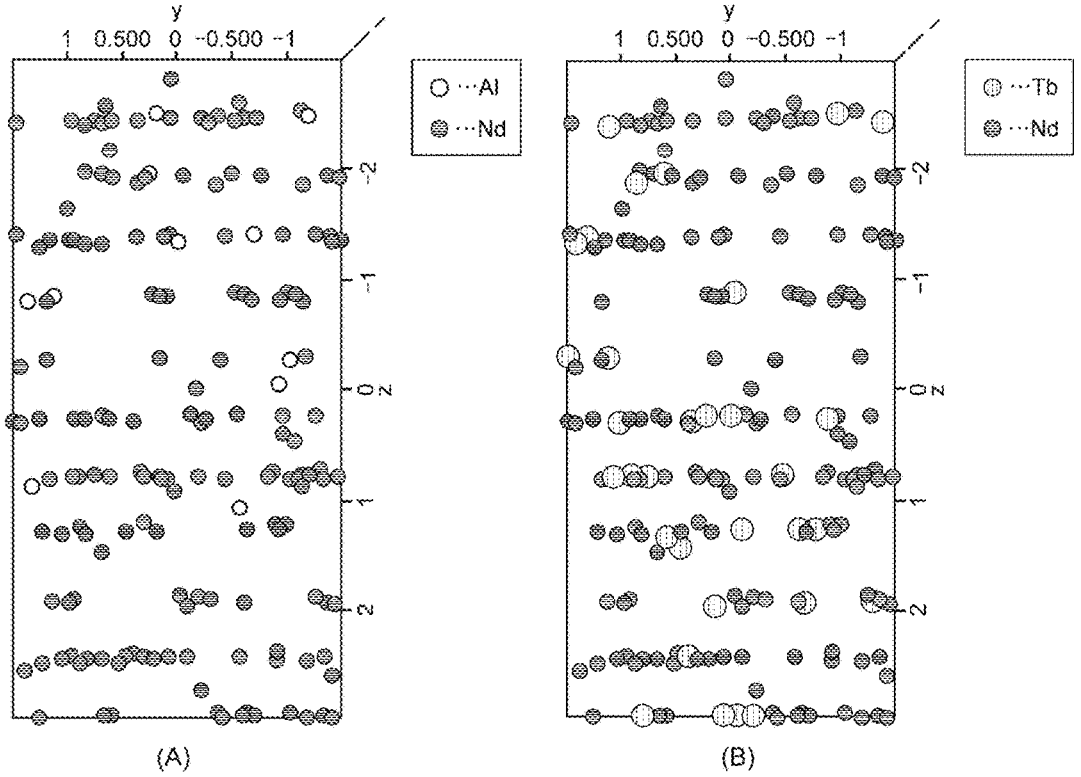
FIG. 17 is an analysis result of the crystal structure by the 3DAP according to an example of the present disclosure.

Furthermore, the 3DAP analysis of Example 6-10 shows that Co, Tb, and Al exist in the Nd—Fe—B layer. FIG. 14(A) is a diagram in which only Nd and B are displayed for the 3DAP analysis of Example 6-10. FIG. 14(B) is a diagram in which only Nd and Fe are displayed for the same 3DAP analysis. FIG. 14(C) is a diagram in which only Nd and Co are displayed as viewed from the x direction. FIG. 15 is a diagram in which only Nd and Co are displayed, by showing FIG. 14(*a*) or FIG. 14(*b*) from the −x direction. FIG. 16 is a model diagram which was created based on the above-described 3DAP analysis and which does not show the substituent atoms in the crystal structure of the main phase of the rare earth permanent magnet according to the present disclosure. Furthermore, FIG. 17(A) is a diagram in which only Nd and Al are displayed for the 3DAP analysis of Example 6-10. FIG. 17(B) is a diagram in which only Nd and Tb are displayed for the 3DAP analysis of Example 6-10.

Figure 18:
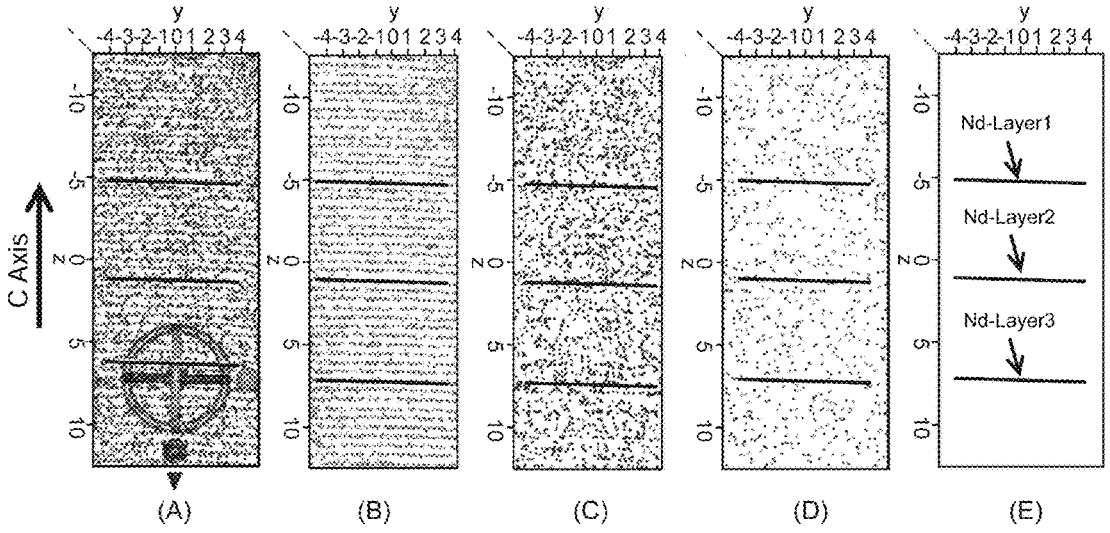
FIG. 18 is an analysis result of the crystal structure by the 3DAP according to an example of the present disclosure.

In addition, the 3DAP analysis of Example 6-10 shows that Co exists in layers parallel to a C axis of the crystal lattice of the main phase. FIG. 18(B) is a diagram in which only neodymium (Nd) is displayed for the 3DAP analysis of Example 6-10. FIG. 18(C) is a diagram in which only boron (B) is displayed. FIG. 18(D) is a diagram in which only cobalt (Co) is displayed. FIG. 18(A) is a diagram prepared by laying FIG. 18(B) to FIG. 18(D) one on top of another. Nd-Layer 1, Nd-Layer 2, and Nd-Layer 3 shown in FIG. 18(E) are analysis areas arbitrarily selected in order to analyze layers perpendicular to the C axis of the crystal lattice of the main phase in Example 6-10.

Figures 19, 20:
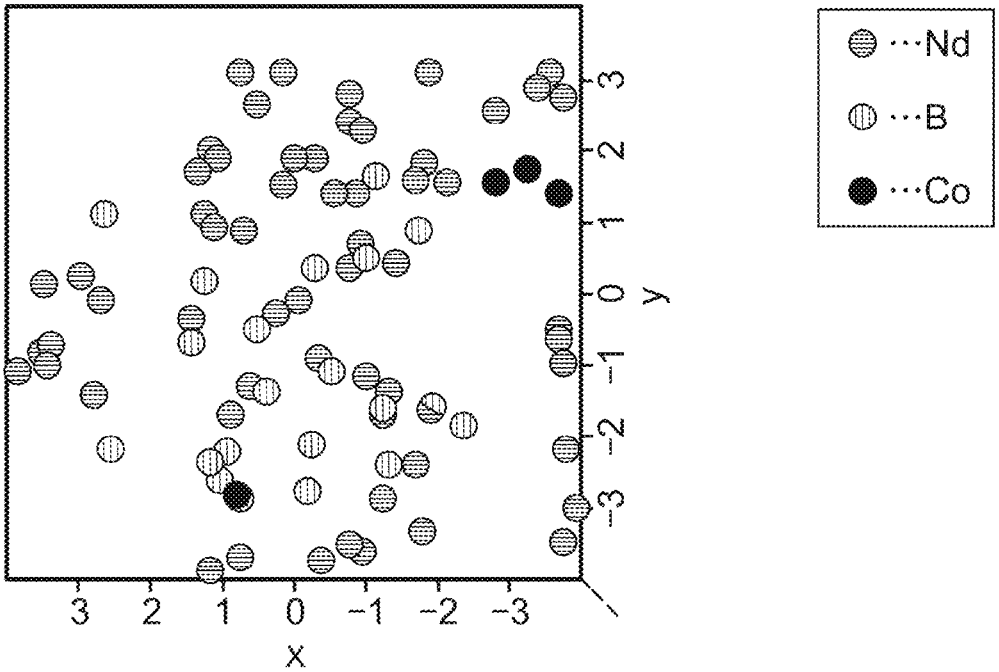
FIG. 19 is an analysis result of the crystal structure by the 3DAP according to an example of the present disclosure.
FIG. 20 is an analysis result of the crystal structure by the 3DAP according to an example of the present disclosure.
Figures 21, 22:
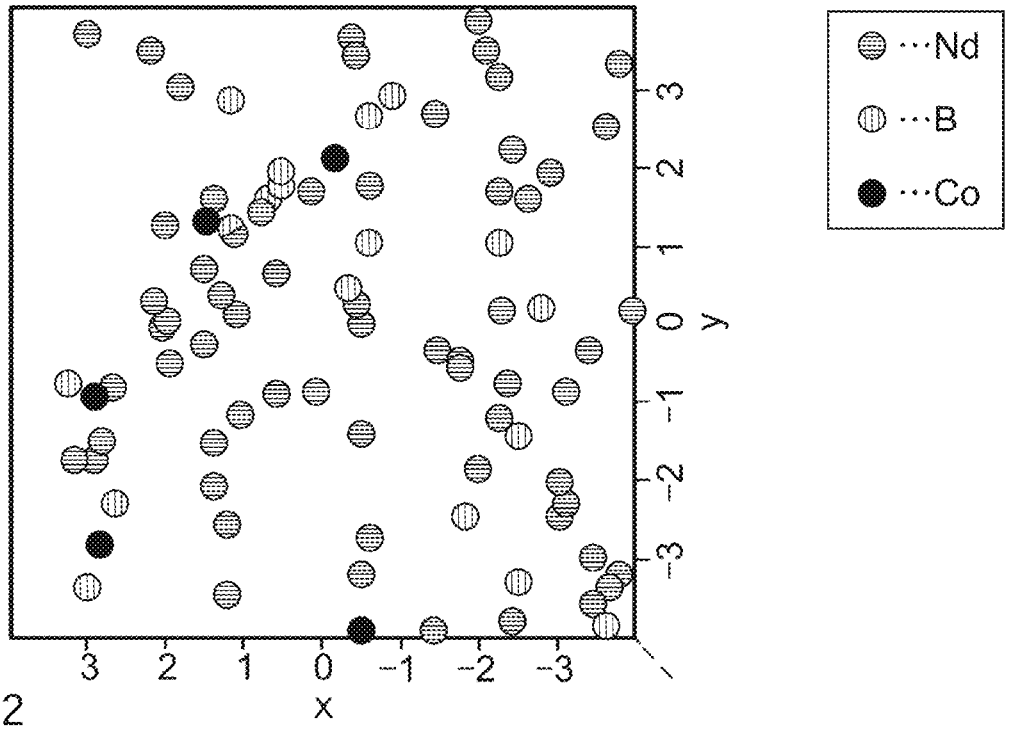
FIG. 21 is an analysis result of the crystal structure by the 3DAP according to an example of the present disclosure.
FIG. 22 is an analysis result of the crystal structure by the 3DAP according to an example of the present disclosure.
Figures 23, 24:
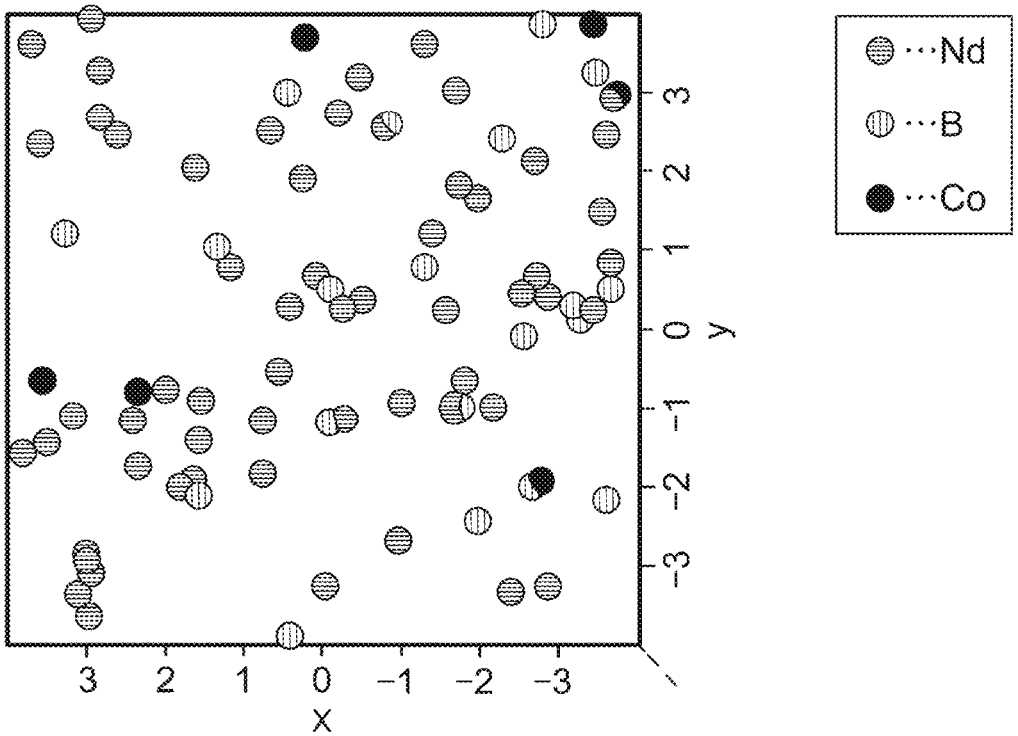
FIG. 23 is an analysis result of the crystal structure by the 3DAP according to an example of the present disclosure.
FIG. 24 is an analysis result of the crystal structure by the 3DAP according to an example of the present disclosure.

FIG. 19 and FIG. 20 are 3DAP analysis results of Nd-Layer 1. FIG. 21 and FIG. 22 are 3DAP analysis results of Nd-Layer 2. FIG. 23 and FIG. 24 are 3DAP analysis results of Nd-Layer 3. FIG. 19 to FIG. 24 show that Co exists in the Nd—Fe—B layer.

Figure 25:
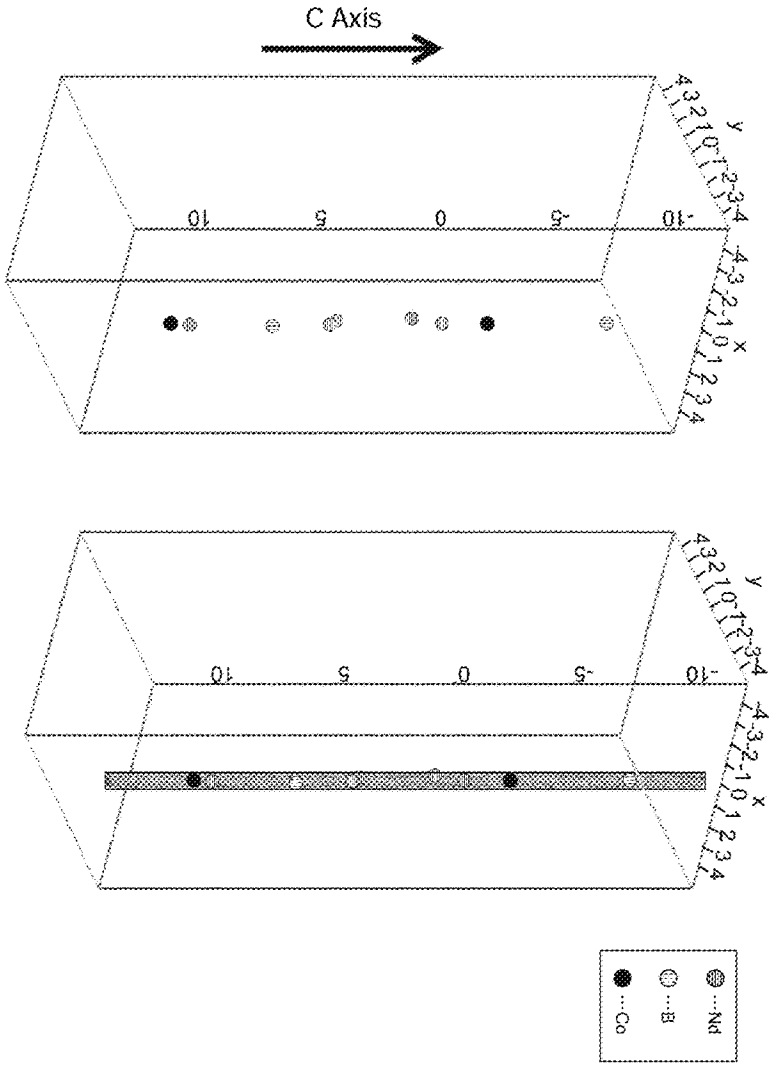
FIG. 25 is an analysis result of the crystal structure by the 3DAP according to an example of the present disclosure.

The 3DAP analysis of Example 6-10 shows that Co exists in the layers parallel to the C axis of the crystal lattice of the main phase. A columnar area in a right diagram of FIG. 25 is an analysis area arbitrarily selected in order to analyze a layer parallel to the C axis of the crystal lattice of the main phase in Example 6-10. A left diagram of FIG. 25 shows that Nd, B, and Co were detected as being aligned in a direction parallel to the C axis in the analysis area indicated in the above-described right diagram of FIG. 25.

[Crystal Structure Analysis by Rietveld Method]

The crystal structure of Example 6-11 was analyzed by the Rietveld method. Analysis methods and analysis conditions are as described below.

[Analysis Methods]

Analysis Test Apparatus: X-ray diffractometer RAD-RRU300 made by Rigaku Corporation Target: Co Monochromatization: a monochrometer was used (Kα)

Target Output: 40 kV-200 mA (Continuous Measurement) θ/2θ scanning

Slits: divergence slit: 1°; scattering slit: 1°; and light reception slit: 0.3 mm Monochrometer Light Reception Slit: 0.6 mm Scan Speed: 0.5°/min Sampling Width: 0.02°

Measured Angle (2θ): 10°–110°

[Analysis Conditions]

The analysis was conducted by the Rietveld method. Analysis software RIETAN-FP was used and reference was made to F. Izumi and K. Momma, "Three-dimensional visualization in powder diffraction" Solid State Phenom., 130, 15-20 (2007). Coordinates were adopted form D. Givord, H.-S. Li and J. M. Moreau, "Magnetic properties and crystal structure of $Nd_2Fe_{14}B$" Solid State Communications, 50, 497-499 (1984).

Figure 26:
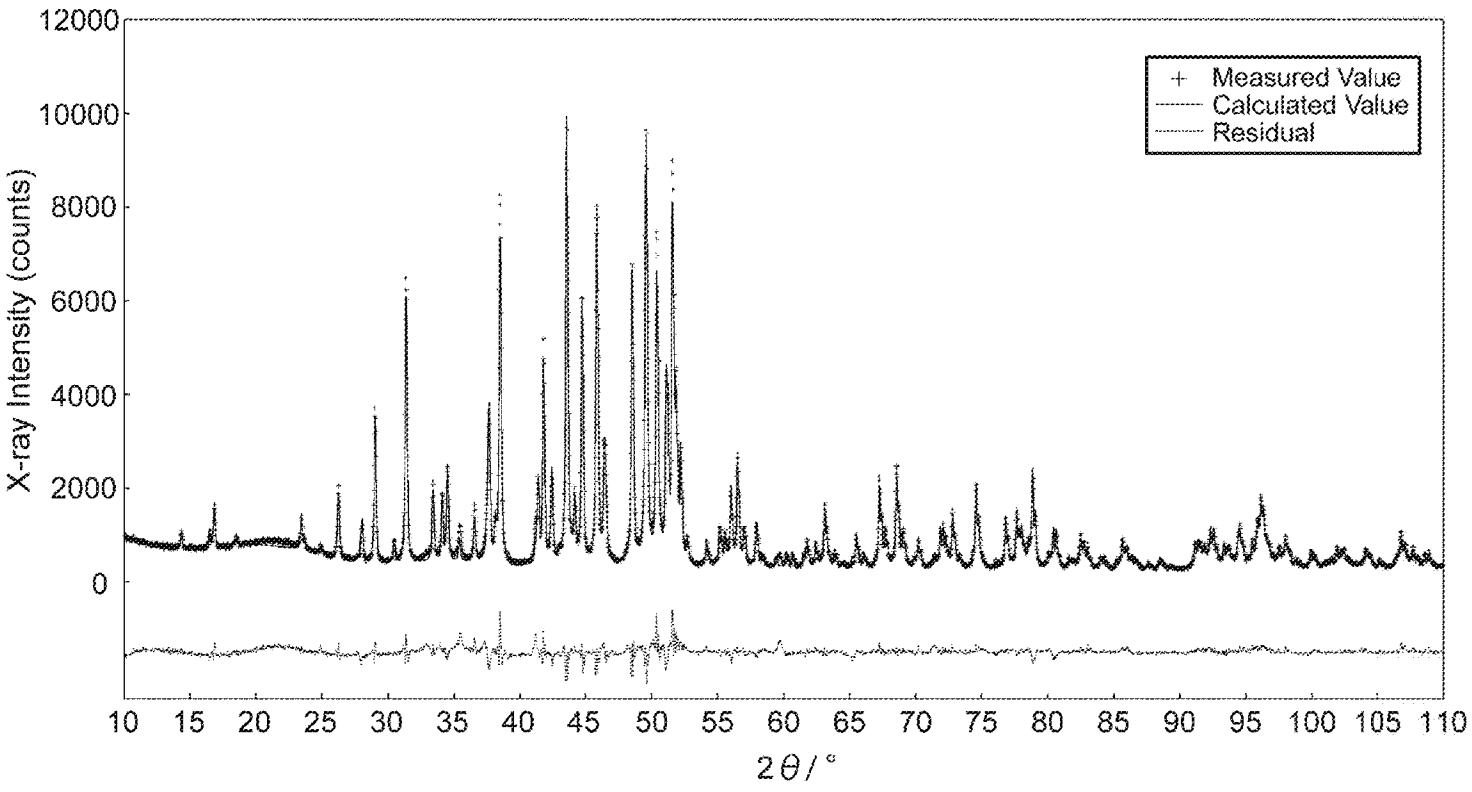
FIG. 26 is an analysis result of the crystal structure by the Rietveld method according to an example of the present disclosure.
Figure 30:
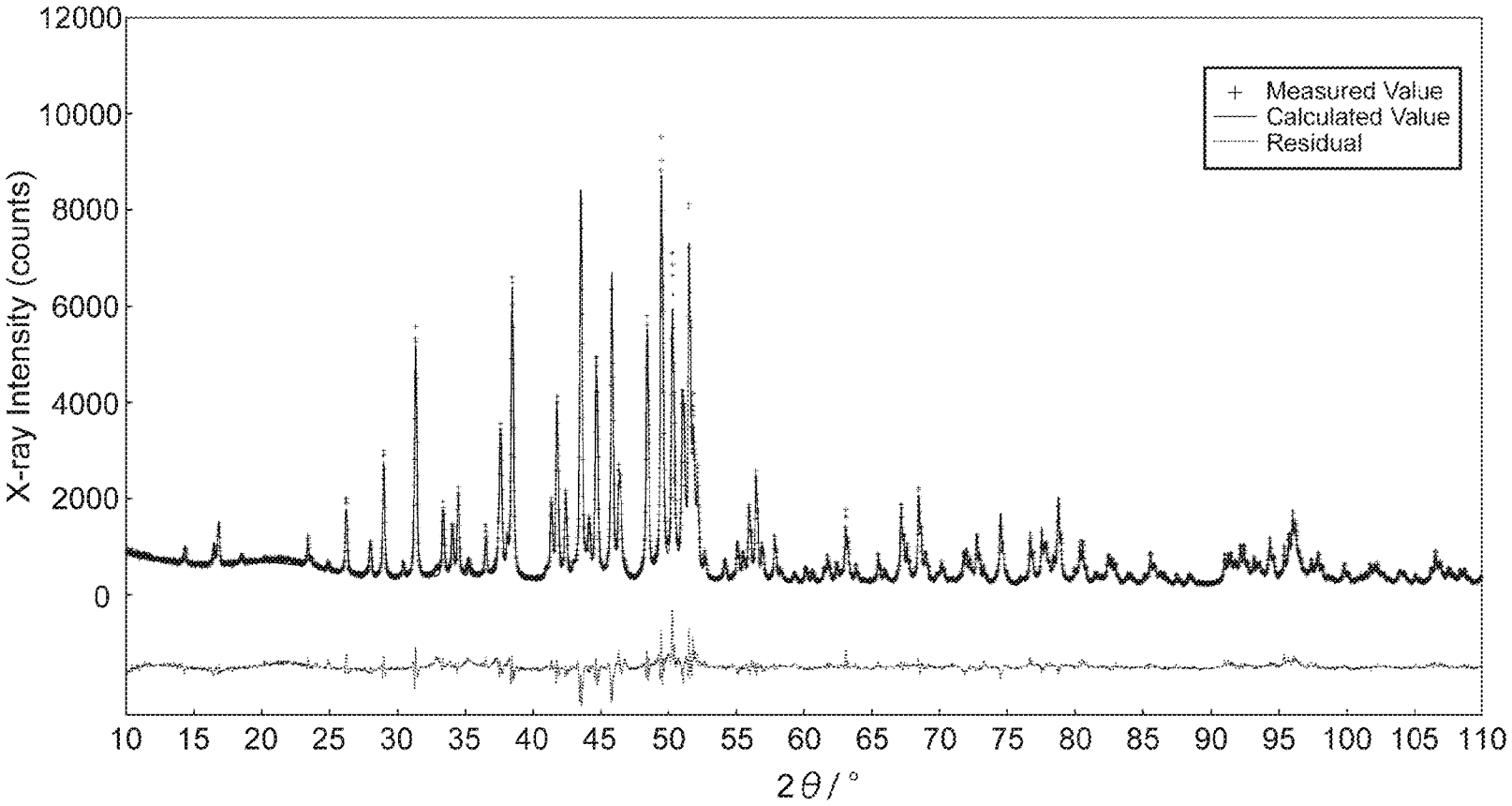
FIG. 30 is an analysis result of the crystal structure by the Rietveld method according to an example of the present disclosure.
Figure 34:
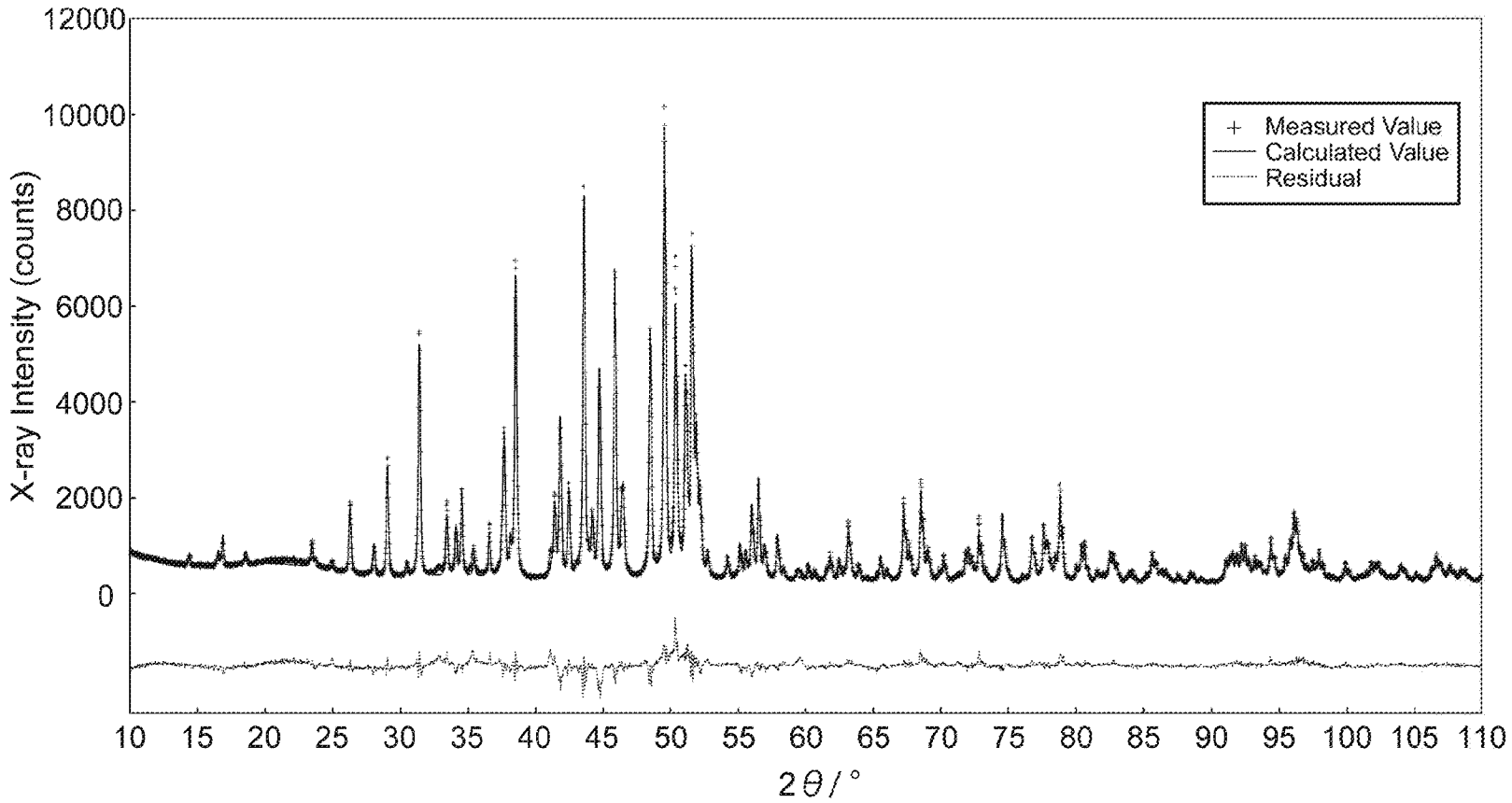
FIG. 34 is an analysis result of the crystal structure by the Rietveld method according to an example of the present disclosure.
Figure 38:
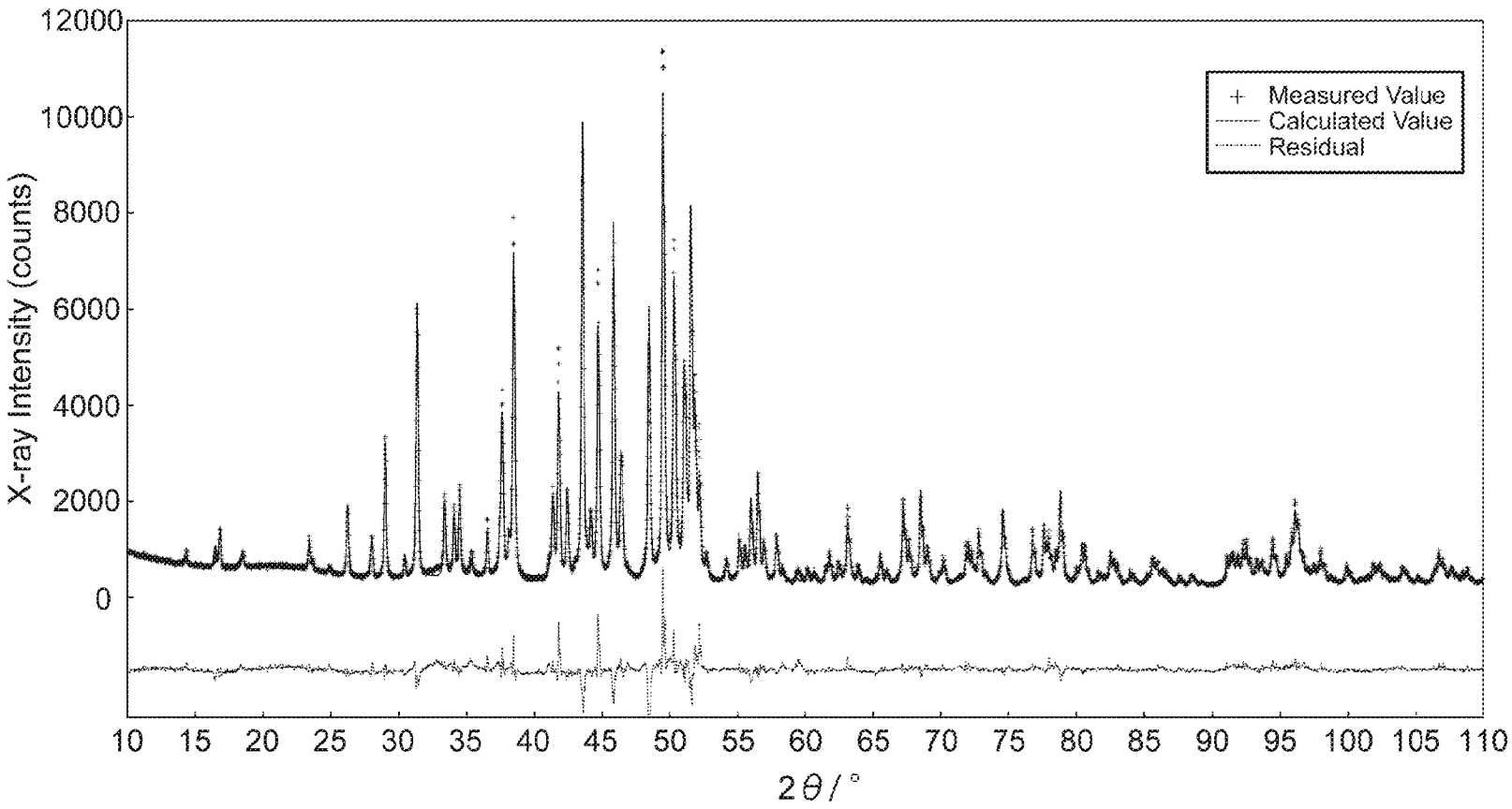
FIG. 38 is an analysis result of the crystal structure by the Rietveld method according to an example of the present disclosure.
Figure 42:
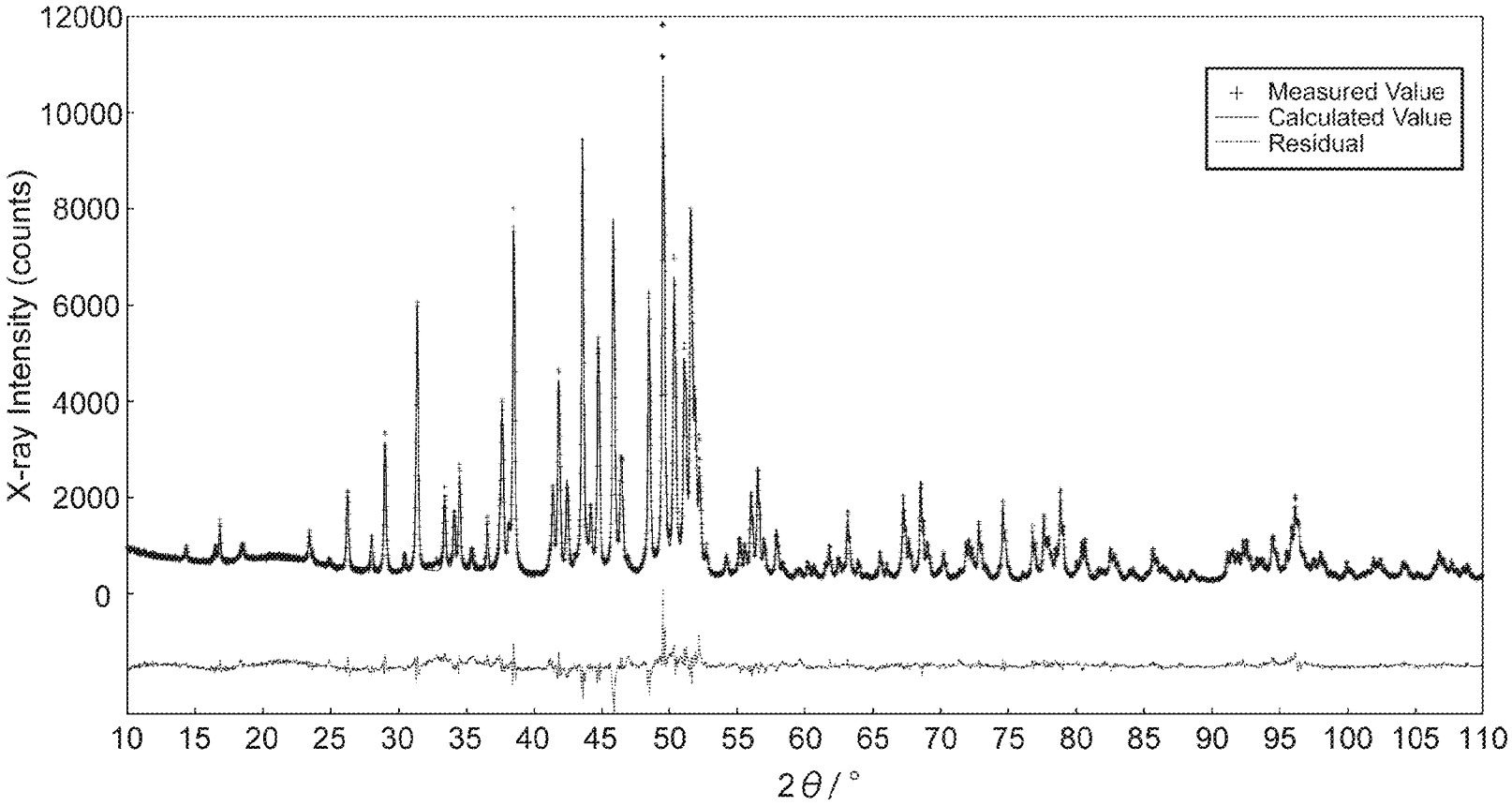
FIG. 42 is an analysis result of the crystal structure by the Rietveld method according to an example of the present disclosure.

The analysis results of the crystal structure by the Rietveld method are shown in the diagrams indicated below. Specifically speaking, the analysis results of Example 6-11 are shown in FIG. 26 and FIG. 27. FIG. 27 shows that a boron site 4f is substituted with cobalt atoms by 7.38%. The analysis results of Example 7-6 are shown in FIG. 30 and FIG. 31. FIG. 31 shows that the boron site 4f is substituted with the cobalt atoms by 7.40%. The analysis results of Example 8-6 are shown in FIG. 34 and FIG. 35. FIG. 35 shows that the boron site 4f is substituted with the cobalt atoms by 9.87%. The analysis results of Example 9-6 are shown in FIG. 38 and FIG. 39. FIG. 39 shows that the boron site 4f is substituted with the cobalt atoms by 3.64%. The analysis results of Example 10-6 are shown in FIG. 42 and FIG. 43. FIG. 43 shows that the boron site 4f is substituted with the cobalt atoms by 8.31%.

The tensile strength of Example 11 was measured in Example 11-1 to Example 11-5. Furthermore, the tensile strength of Example 12 was measured in Example 12-1 to Example 12-5. The measurement method is the same as in Example 6. Table 5 shows the measurement results.

TABLE 5

| | Tensile Strength (MPa) |
|---|---|
| Example 11-1 | 135.29 |
| Example 11-2 | 129.73 |
| Example 11-3 | 123.50 |
| Example 11-4 | 102.61 |
| Example 11-5 | 113.73 |
| Example 12-1 | 93.98 |
| Example 12-2 | 102.74 |
| Example 12-3 | 91.29 |
| Example 12-4 | 81.34 |
| Example 12-5 | 93.17 |

Example 13 and Example 14

Raw material alloys containing the respective elements with the content indicated in Example 13 and Example 14 in FIG. 7 were ground. Grinding was conducted with a jet mill and alloy particles of different particle sizes were prepared. Subsequently, the alloy particles were dispersed in a solvent and an additive was introduced to the dispersed solution, which was then stirred to cause a reduction reaction. FIG. 45 and FIG. 46 show the particle sizes of the obtained fine alloy powder. Incidentally, a mixing ratio of the fine mixed powder in Example 13 and Example 14 in FIG. 47 is a weight ratio of 1:1. The powder particle size and the sintered particle size were measured with an apparatus equivalent to a laser-diffraction-type particle-size distribution measuring apparatus SALD-2300 made by SHIMADZU CORPORATION.

The molding cavity was filled with 500 g of the fine alloy powder of Example 13, or with 500 g of the fine alloy powder which was a mixture of Example 13 and Example 14, and a 19 kOe magnetic field with a molding pressure of 2 t/cm$^2$ was applied to the fine alloy powder to conduct compression molding and magnetization. The heat treatment was applied to each obtained molded body under a $2\times10^1$ Torr Ar gas atmosphere under the conditions indicated in FIG. 45 to FIG. 47. After the heat treatment terminated, the temperature was cooled down to a room temperature. Then, the obtained product was removed from the cavity, thereby obtaining a rare earth permanent magnet of Example 13 and a rare earth permanent magnet of the mixed alloy of Example 13 and Example 14.

The residual magnetic flux density Br, the coercive force $H_{cJ}$, and the maximum energy product $BH_{max}$ were measured by the same method as in Example 6. The measurement results are shown in FIG. 45 to FIG. 47.

Comparative Example 1 and Comparative Example 2

Each of raw material alloys containing the respective elements with the content indicated in Comparative Example 1 and Comparative Example 2 in FIG. 7 was ground, thereby obtaining alloy particles with an average particle diameter of 16 μm. Subsequently, the alloy particles were dispersed in a solvent and an additive was introduced to the dispersed solution, which was then stirred to cause a reduction reaction, thereby refining the allow particles. An average particle diameter of the obtained fine alloy powder was 3 to 25 μm. The average particle diameter was measured with the apparatus equivalent to the laser-diffraction-type particle-size distribution measuring apparatus SALD-2300 made by SHIMADZU CORPORATION.

The molding cavity was filled with 500 g of the obtained fine alloy powder and a 30 kOe magnetic field with a molding pressure of 2 t/cm$^2$ was applied to the alloy powder of each comparative example to conduct compression molding and magnetization. The heat treatment was applied to each obtained molded body under a $2\times10^1$ Torr Ar gas atmosphere. The heat treatment step was conducted under the heat treatment conditions indicated in FIG. 48. In each case, After the heat treatment terminated, the molded body was cooled down to a room temperature. A contracted state of the molded bodies of Comparative Example 1 and Comparative Example 2 after being cooled is shown in FIG. 48. Referring to FIG. 48, each of the molded bodies of Comparative Example 1 and Comparative Example 2 after being cooled did not contract sufficiently. Such molded bodies tend to easily burn in a subsequent processing step. Therefore, it is presumed that the fine alloy powder having the compositions of Comparative Example 1 and Comparative Example 2 will not become the magnets of the present disclosure.

The rare earth permanent magnet of the present disclosure exhibits a high magnetic moment and has a good magnetic property. The rare earth permanent magnet contributes to downsizing, weight reduction, and cost reduction of, for example, electric motors, offshore wind power generators, and industrial motors. Since the rare earth permanent magnet exhibits an excellent magnetic property under high temperature conditions, it is suited for the use in automobiles and industrial motors.

REFERENCE SIGNS LIST

100 crystal structure of $Nd_2Fe_{14}B_{(1-x)}M_x$
101 Fe layer
102 Nd—B-M layer
103 interstice
200 crystal structure of $Nd_2Fe_{(14-y)}L_yB_{(1-x)}M_x$
201 Fe-L layer
202 Nd—B-M layer
203 interstice
300 main phase
400 grain boundary phase
500 unit lattice of main phase
501 Fe layer
502 Nd—Fe—B layer

The invention claimed is:

1. A rare earth permanent magnet with a compound represented by a following expression (1) as a main phase:

[Chem. 1]

$$Nd_2Fe_{14}B_{(1-x)}M_x \quad (1)$$

wherein in the expression (1), M represents an element selected from any one of cobalt, beryllium, lithium, aluminum, and silicon and x satisfies $0.01 \leq x \leq 0.25$, and wherein a composition ratio of TRE, B, and Fe in the rare earth permanent magnet is:

$2.33 \leq (TRE/B) \leq 2.48$ and $13.18 \leq (Fe/B) \leq 13.52$, where TRE represents rare earth elements including Nd, the composition ratio TRE/B is the at % of TRE divided by the at % of B, and the composition ratio of Fe/B is the at % of Fe divided by the at % of B.

2. The rare earth permanent magnet according to claim 1, wherein in the expression (1), the compound in which x satisfies $0.03 \leq x \leq 0.25$ is used as the main phase.

3. A rare earth permanent magnet with a compound represented by a following expression (2) as a main phase:

[Chem. 2]

$$Nd_2Fe_{(14-y)}L_yB_{(1-x)}M_x \quad (2)$$

wherein in the expression (2), M and L are elements selected from any one of cobalt, beryllium, lithium, aluminum, and silicon, y is $0<y<2$, x is $0.01 \leq x \leq 0.25$, and x and y satisfy $0.01<(x+y)<2.25$.

4. The rare earth permanent magnet according to claim 3, wherein in the expression (2), the compound in which y is $0.1<y<1.2$, x is $0.02 \leq x \leq 0.25$, and x and y satisfy $0.12<(x+y)<1.45$ is used as the main phase.

5. A rare earth permanent magnet whose main phase has an Nd—Fe—B layer and an Fe layer periodically and part of boron contained in the Nd—Fe—B layer is substituted with any one or more types of elements selected from a group consisting of cobalt, beryllium, lithium, aluminum, and silicon.

6. The rare earth permanent magnet according to claim 5, wherein the Nd—Fe—B layer contains terbium.

7. The rare earth permanent magnet according to claim 5, wherein the Nd—Fe—B layer contains any one or more types of elements of praseodymium and dysprosium.

8. The rare earth permanent magnet according to any one of claim 1, claim 3, and claim 5, wherein a content of neodymium is 20 to 35 wt %, a content of boron is 0.80 to 0.99 wt %, and a total content of any one or more types of elements selected from a group consisting of cobalt, beryllium, lithium, aluminum, and silicon is 0.8 to 1.0 wt % relative to a total weight of the rare earth permanent magnet.

9. The rare earth permanent magnet according to any one of claim 1, claim 3, and claim 5, comprising the main phase containing terbium.

10. The rare earth permanent magnet according to any one of claim 1, claim 3, and claim 5, wherein a content of neodymium is 20 to 35 wt %, a content of boron is 0.80 to 0.99 wt %, a total content of any one or more types of elements selected from a group consisting of cobalt, beryllium, lithium, aluminum, and silicon is 0.8 to 1.0 wt %, and a content of terbium is 2.0 to 10.0 wt % relative to a total weight of the rare earth permanent magnet.

11. The rare earth permanent magnet according to any one of claim 1, claim 3, and claim 5, comprising the main phase containing any one or more types of elements of praseodymium and dysprosium.

12. The rare earth permanent magnet according to any one of claim 1, claim 3, and claim 5, wherein a content of neodymium is 15 to 40 wt %, a content of praseodymium is 5 to 20 wt %, a content of boron is 0.80 to 0.99 wt %, a total content of any one or more types of elements selected from a group consisting of cobalt, beryllium, lithium, aluminum, and silicon is 0.8 to 1.0 wt %, and a content of terbium is 2.0 to 10.0 wt % relative to a total weight of the rare earth permanent magnet.

13. The rare earth permanent magnet according to any one of claim 1, claim 3, and claim 5, comprising the main phase and a grain boundary phase containing any one or more types of elements selected from a group consisting of aluminum, copper, niobium, zirconium, titanium, and gallium.

14. The rare earth permanent magnet according to any one of claim 1, claim 3, and claim 5, comprising a grain boundary phase containing at least 0.1 to 0.4% aluminum and 0.01 to 0.1% copper by weight by percent.

15. The rare earth permanent magnet according to any one of claim 1, claim 3, and claim 5, wherein the main phase contains a crystal containing neodymium, iron, boron and containing any one or more types of elements selected from a group consisting of cobalt, beryllium, lithium, aluminum, and silicon, and a sintered particle size $D_{50}$ of the crystal is 2 to 25 μm.

16. The rare earth permanent magnet according to any one of claim 1, claim 3, and claim 5, wherein a sintered density is 6.0 to 8.0 g/cm$^3$.

17. The rare earth permanent magnet according to claim 9, wherein the rare earth permanent magnet has a magnetic property that satisfies any one or more conditions of a group consisting of mc7 and mc8 mentioned below at a temperature condition of 200° C.:

mc7: a residual magnetic flux density Br is 10.10 kG or more; and mc8: a coercive force Hcj is 6.60 kOe or more.

18. The rare earth permanent magnet according to claim 11, wherein the rare earth permanent magnet has a magnetic property that satisfies any one or more conditions of a group consisting of mc15 and mc16 mentioned below at a temperature condition of 200° C.:

mc15: a residual magnetic flux density Br is 9.60 kG or more; and mc16: a coercive force Hcj is 3.80 kOe or more.

19. The rare earth permanent magnet according to claim 13, wherein the rare earth permanent magnet has a magnetic property that satisfies any one or more conditions of a group consisting of mc23 and mc24 mentioned below at a temperature condition of 200° C.:

mc23: a residual magnetic flux density Br is 9.00 kG or more; and mc24: a coercive force Hcj is 6.70 kOe or more.

20. The rare earth permanent magnet according to any one of claim 1, claim 3, and claim 5, wherein tensile strength is 80 MPa or more.

21. A rare earth permanent magnet manufacturing method comprising a heat treatment step of: retaining a raw material compound which contains neodymium, iron, and boron, and contains any one or more types of elements selected from a group consisting of cobalt, beryllium, lithium, aluminum, and silicon, and contains any one or more types of elements selected from a group consisting of aluminum, copper, niobium, zirconium, titanium, and gallium, at a main-phase-forming temperature and then lowering the main-phase-forming temperature to a grain-boundary-phase-forming temperature, thereby forming a main phase containing neodymium, iron, and boron, containing any one or more types of elements selected from a group consisting of cobalt, beryllium, lithium, aluminum, and silicon, and containing terbium; and further retaining the raw material compound at the grain-boundary-phase-forming temperature, thereby forming a grain boundary phase containing any one or more types of elements selected from a group consisting of aluminum, copper, niobium, zirconium, titanium, and gallium.

22. The rare earth permanent magnet manufacturing method according to claim 21, comprising the heat treatment step of: retaining a raw material compound which contains neodymium, praseodymium, iron, and boron, contains any one or more types of elements selected from a group consisting of cobalt, beryllium, lithium, aluminum, and silicon, contains one or more types of elements of terbium and dysprosium, and contains any one or more types of elements selected from a group consisting of aluminum, copper, niobium, zirconium, titanium, and gallium, at the main-phase-forming temperature and then lowering the main-phase-forming temperature to the grain-boundary-phase-forming temperature, thereby forming the main phase containing neodymium, praseodymium, iron, and boron, and further containing any one or more types of elements selected from a group consisting of cobalt, beryllium, lithium, aluminum, and silicon, and containing any one or more types of elements of terbium and dysprosium; and retaining the raw material compound at the grain-boundary-phase-forming temperature, thereby forming the grain boundary phase containing any one or more types of elements selected from a group consisting of aluminum, copper, niobium, zirconium, titanium, and gallium.

23. The rare earth permanent magnet manufacturing method according to claim 21 or claim 22, comprising the heat treatment step of retaining the raw material compound at 1000 to 1200° C. for 3 to 5 hours, then retaining it at 880 to 920° C. for 4 to 5 hours, and then retaining it at 480 to 520° C. for 3 to 5 hours.

24. The rare earth permanent magnet according to any one of claim 1, claim 3, and claim 5, comprising the main phase containing any one or more types of elements of praseodymium and dysprosium, wherein the main phase contains terbium.

25. The rare earth permanent magnet according to any one of claims 1, 3, and 5, wherein a crystal belongs to $P4_2/mnm$ and part of B atoms occupying a site 4f of the crystal is substituted with atoms of one or more types of elements selected from the group consisting of cobalt, beryllium, lithium, aluminum, and silicon; and wherein part of one or more types of atoms selected from a group consisting of Nd atoms occupying the site 4f of the crystal belonging to $P4_2/mnm$, Fe atoms occupying a site 4c of the crystal, and Fe atoms occupying a site 8j of the crystal is substituted with atoms of one or more types of elements selected from the group consisting of cobalt, beryllium, lithium, aluminum, and silicon.

* * * * *